US007268300B2

(12) United States Patent
Miyazaki

(10) Patent No.: US 7,268,300 B2
(45) Date of Patent: Sep. 11, 2007

(54) CONNECTOR FOR INVERTER

(75) Inventor: Sho Miyazaki, Mie (JP)

(73) Assignees: Autonetworks Technologies, Ltd., Mie (JP); Aumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/940,709

(22) Filed: Sep. 15, 2004

(65) Prior Publication Data

US 2005/0090132 A1 Apr. 28, 2005

(30) Foreign Application Priority Data

Sep. 16, 2003 (JP) ..... 2003-323138

(51) Int. Cl.
*H01B 17/00* (2006.01)
*H01B 4/70* (2006.01)

(52) U.S. Cl. ..... 174/138 F; 174/138 R; 439/449

(58) Field of Classification Search ..... 174/138 F, 174/138 R, 149 R; 439/449, 457
See application file for complete search history.

(56) References Cited

U.S. PATENT DOCUMENTS 6,737,773 B2 * 5/2004 Hayashi et al. ..... 310/71

FOREIGN PATENT DOCUMENTS

JP A 2002-008787 1/2002

* cited by examiner

*Primary Examiner*—Jinhee Lee
(74) *Attorney, Agent, or Firm*—Oliff & Berridge PLC

(57) ABSTRACT

A connector includes an apparatus-side connector housing attached to a casing of an inverter. The apparatus side-connector housing has a plurality of busbars. Each of the busbars has on one end portion a terminal fitting portion where a mating connector of the apparatus-side connector housing is connected and on the other portion an inverter-side terminal portion where an output terminal of the inverter main circuit board is connected. The busbars are divided and arranged into groups respectively corresponding to the U, V and W phases with respect to the inverter-side terminal portion. The busbars are arranged into groups respectively including the U, V and W three-phases for connection to each of the three-phase loads, with respect to the terminal fitting portion. A wire connecting inverter with a plurality of there phase loads can be arranged with respect to each of three phase loads with small space.

7 Claims, 19 Drawing Sheets

CONNECTOR FOR INVERTER

BACKGROUND OF THE INVENTION

1. Field of the Invention

The present invention relates to a connector for an inverter.

2. Description of the Related Art

In a hybrid vehicle in which a gasoline engine and a motor are used in combination as a power source, a single inverter 1 may be connected to two three-phase motors, one for starting the engine and the other for assisting a driving force. In this case the inverter 1 is provided with output terminals 1A including a total of 6 output terminals, i.e. U-phase, V-phase and W-phase output terminals corresponding to the respective motors. These output terminals 1A are usually aligned in a row such that in-phase output terminals are adjacently located, so as to simplify a structure of the inverter main circuit. For example, when two each of output terminals 1A for the respective phases of U, V and W are designated as U1, U2, V1, V2, W1 and W2, U1 and U2 are disposed next to each other, then V1 and V2 next to each other, and finally W1 and W2 are located next to each other.

Now, for supplying an output of this type of inverter apparatus 1 to a three-phase load, a connector 2 is currently employed. In the case of the inverter apparatus 1 constituted as above, an apparatus-side connector housing 3A provided with six terminal fittings is attached to a casing 1B of the inverter apparatus 1, while wires 4 extending from the motor are connected to a wire-side connector housing 5A also provided with six terminal fittings (not shown), so that insert-fitting the connector housings 3A and 5A achieves connection of the inverter apparatus 1 and the motor (See FIG. 19).

An example of such a connector 2 is disclosed in JP-A-2002-8787. This connector includes a wire-side connector 5 attached to terminals of the wires 4 and an apparatus-side connector 3 attached to an apparatus, and the wire-side connector housing 5A is provided with a terminal chamber (not shown) in which a plurality of wire-side terminals (not shown) can be stored, while the apparatus-side connector housing 3A is provided with a plurality of apparatus-side terminals (not shown) connectible to the wire-side terminals (not shown).

SUMMARY OF THE INVENTION

In the above connector, since two each of output terminals 1A for the U, V and W phases are led out side by side from the inverter main circuit board, the wires 4 led out of the wire-side connector housing 5A also must include two wires each for the U, V and W phases. On the other hand, since one each of the wires respectively corresponding to the U, V and W phases must be grouped for the respective motors, the wires 4 require to be bent in a large radius after being led out of the wire-side connector housing 5A, to be thereby divided into separate wires 4 for the respective motors.

However, a thick wire must be employed as the wires 4 because a large current capacity is required, and in the case of employing a shielded wire the wires 4 become thicker still. Accordingly, since such wires are difficult to bend, a portion of the wire which is bent toward each motor inevitably becomes bulky. Further, since two wires disposed side by side in each pair of wires 4 must be rearranged to constitute a group according to the three phases, the wires form multi-level intersections, thereby making the bent portion still bulkier. Consequently, a large space is required for distribution of the wires 4.

The present invention has been conceived in view of the foregoing problem.

It is an object to provide a connector for an inverter (hereinafter simply referred to as "inverter connector") that requires only a small space for distributing wires toward a plurality of three-phase loads, for connecting the inverter to the respective three-phase loads.

According to the first aspect of the present invention, when the apparatus-side connector housing and the wire-side connector housing are fitted, the wires connected to the wire connection portion are already grouped so as to include the U, V and W phases for the respective loads, when led out of the wire-side connector housing. Such a configuration eliminates the need of bending the wires in a large radius when directing the wires toward the respective loads, thereby permitting distributing the wires to the respective loads in a smaller space.

According to the second aspect of the present invention, since the busbars are formed by molding so as to be integrally retained in the wire-side connector housing, the number of manufacturing processes can be reduced unlike a case of press-fitting the busbars into the wire-side connector housing, which results in improvement in productivity and reduction in manufacturing cost. Also, since the busbars and the wire-side connector housing are more firmly joined, a backlash or the like can be prevented.

According to the third aspect of the present invention, the terminal fitting portions provided in the apparatus-side connector housing are grouped so as to include the U, V and W phases for the respective loads. Therefore, once the apparatus-side connector housing is fitted to the wire-side connector housing, which may be attached to a terminal portion of the wires, the wires led out of the wire-side connector housing are already grouped so as to include the U, V and W phases for the respective loads. Such a configuration eliminates the need of bending the wires in a large radius when directing the wires toward the respective loads, thereby permitting distributing the wires to the respective loads in a smaller space.

According to the fourth aspect of the present invention, since the busbars are formed by molding so as to be integrally retained in the apparatus-side connector housing, the number of manufacturing processes can be reduced unlike a case of press-fitting the busbars into the apparatus-side connector housing, which results in improvement in productivity and reduction in manufacturing cost. Also, since the busbars and the apparatus-side connector housing are more firmly joined, a backlash or the like can be prevented.

According to the fifth aspect of the present invention, the apparatus-side connector housing can be shielded.

When performing a molding process, the busbar may be deformed by an injection pressure to thereby make contact with another busbar. Widening a gap between busbars could be an option for preventing the busbars from contacting each other, however, this leads to an increase in width or bulk of the inverter connector. By contrast, according to the present invention, isolating the busbars with the separators securely prevents the busbars from contacting each other due to an injection pressure, and hence reducing a gap between the busbars, thus making it possible to miniaturize the inverter connector unit.

DESCRIPTION OF THE PREFERRED EMBODIMENTS

Figure 1:
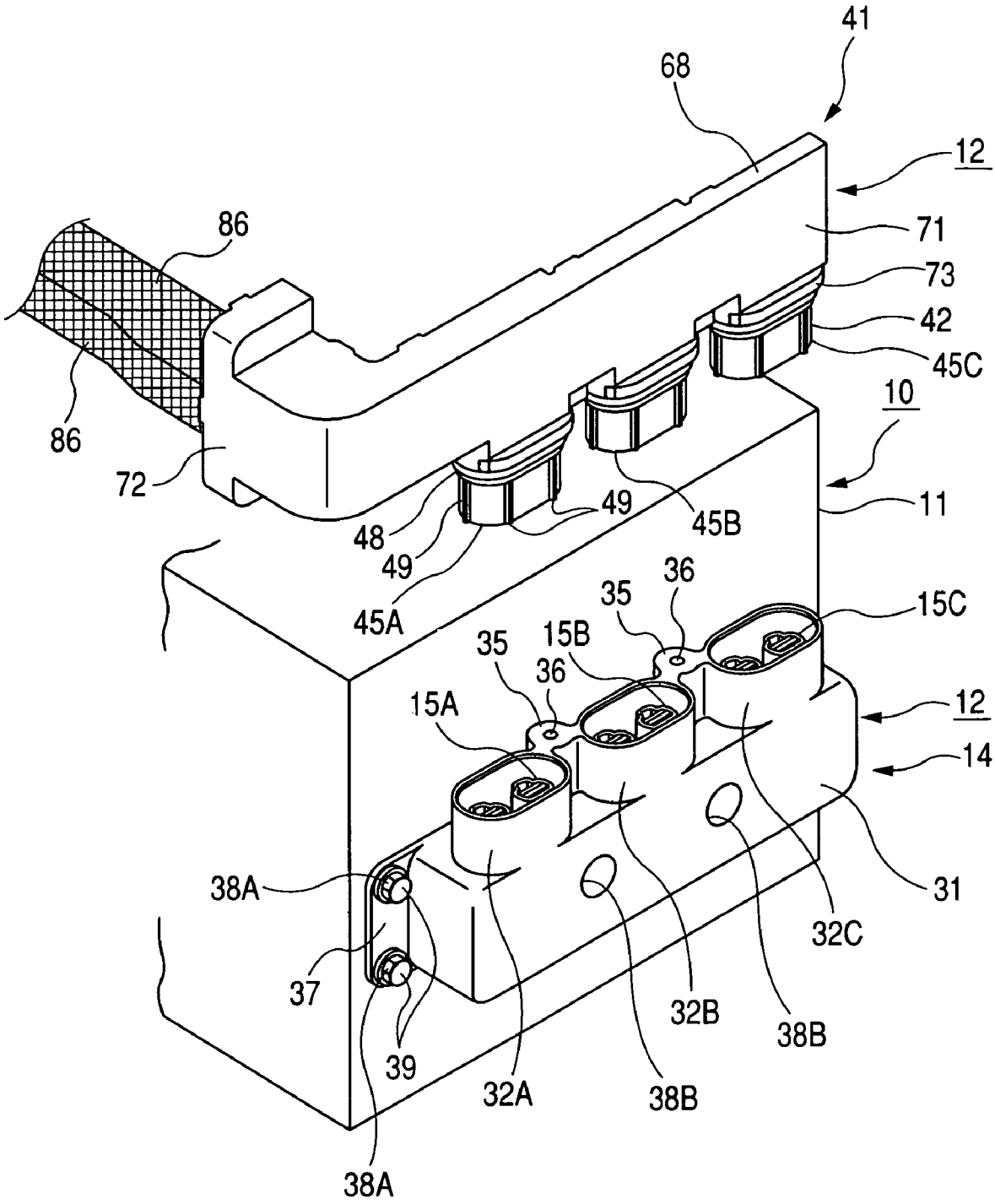
FIG. 1 is a perspective view showing a wire-side connector separated from an apparatus-side connector, according to the first embodiment.
Figure 2:
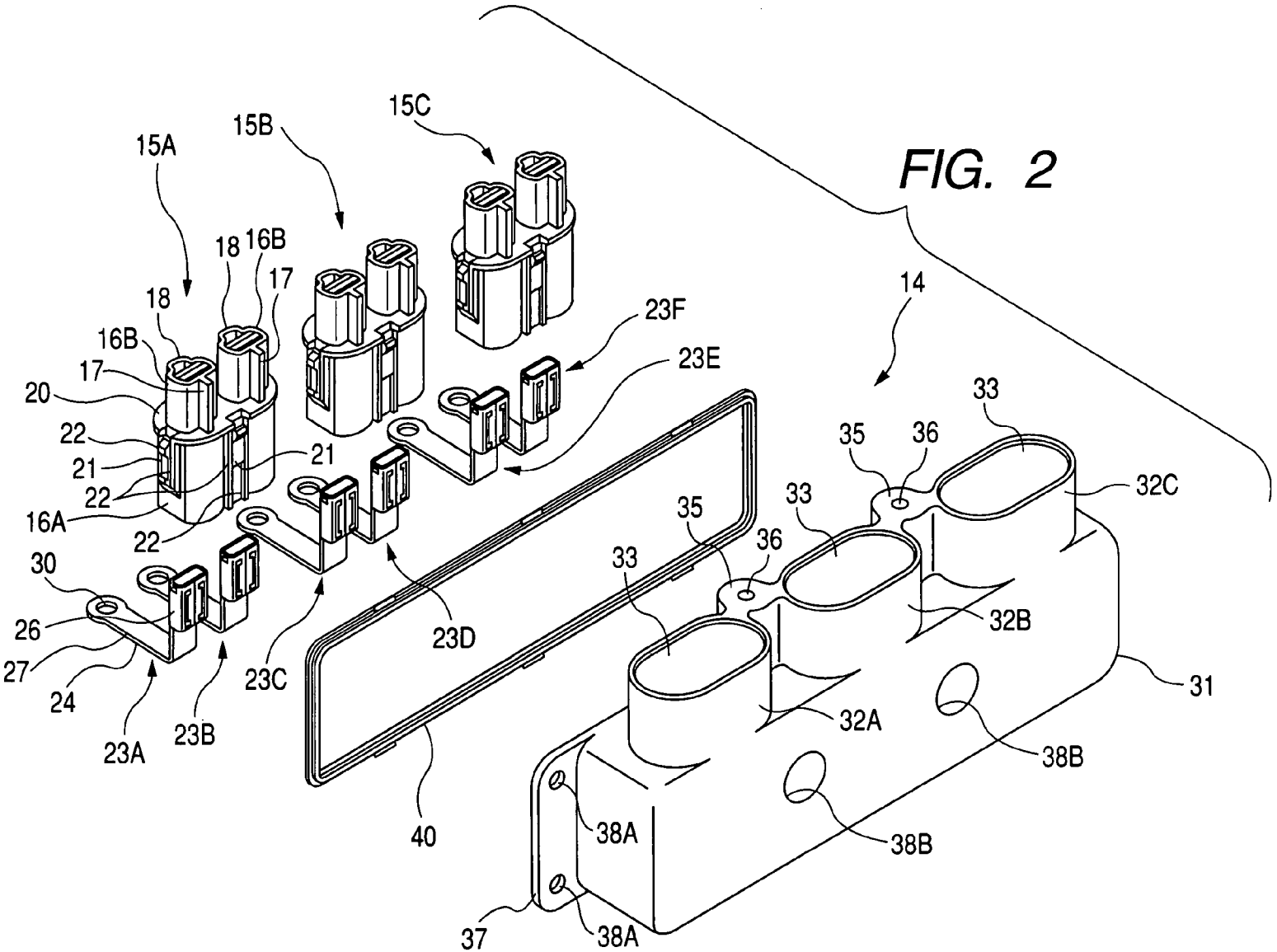
FIG. 2 is an exploded perspective view showing the apparatus-side connector.
Figure 3:
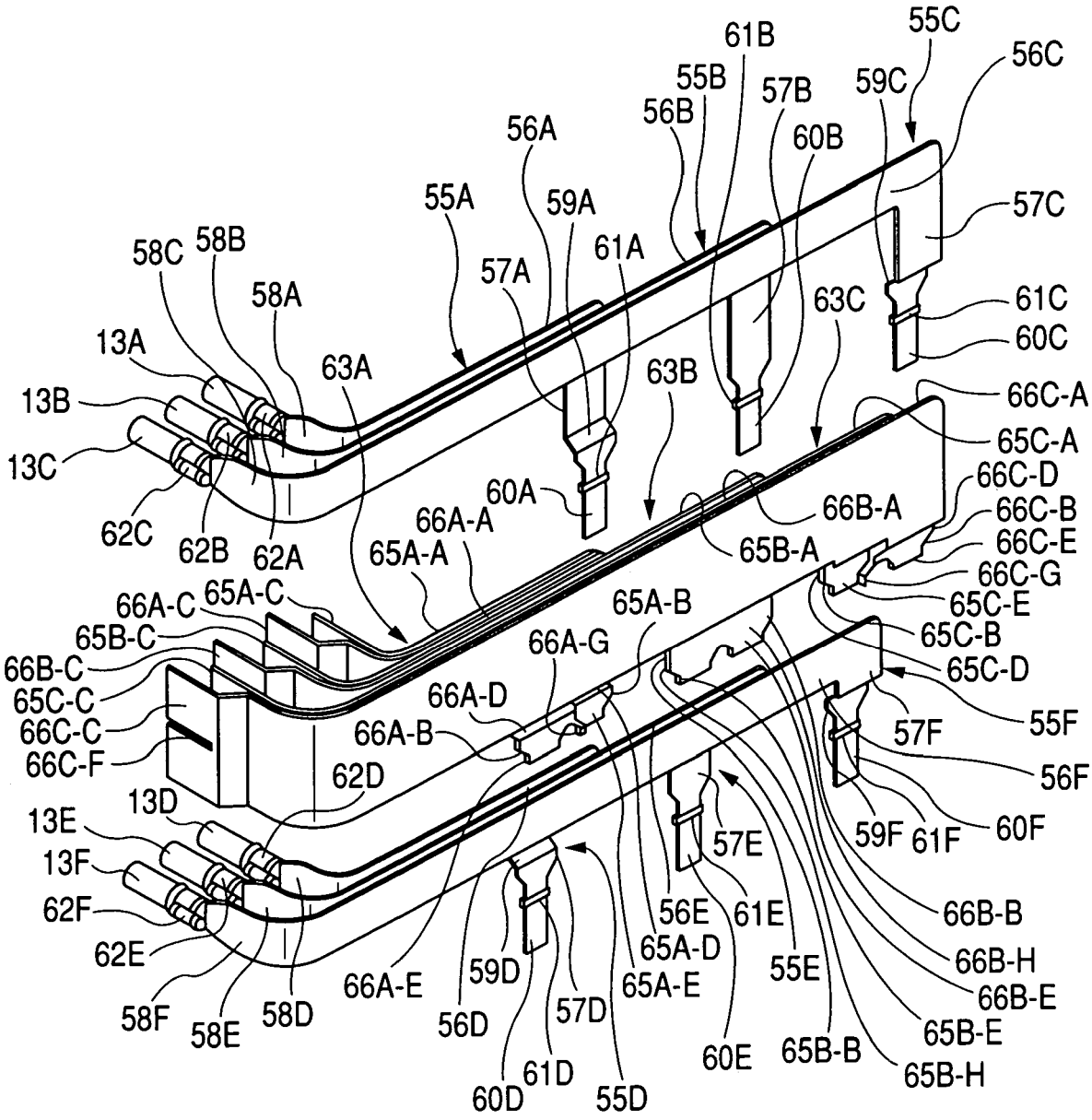
FIG. 3 is an exploded perspective view showing busbars and separators.
Figure 4:
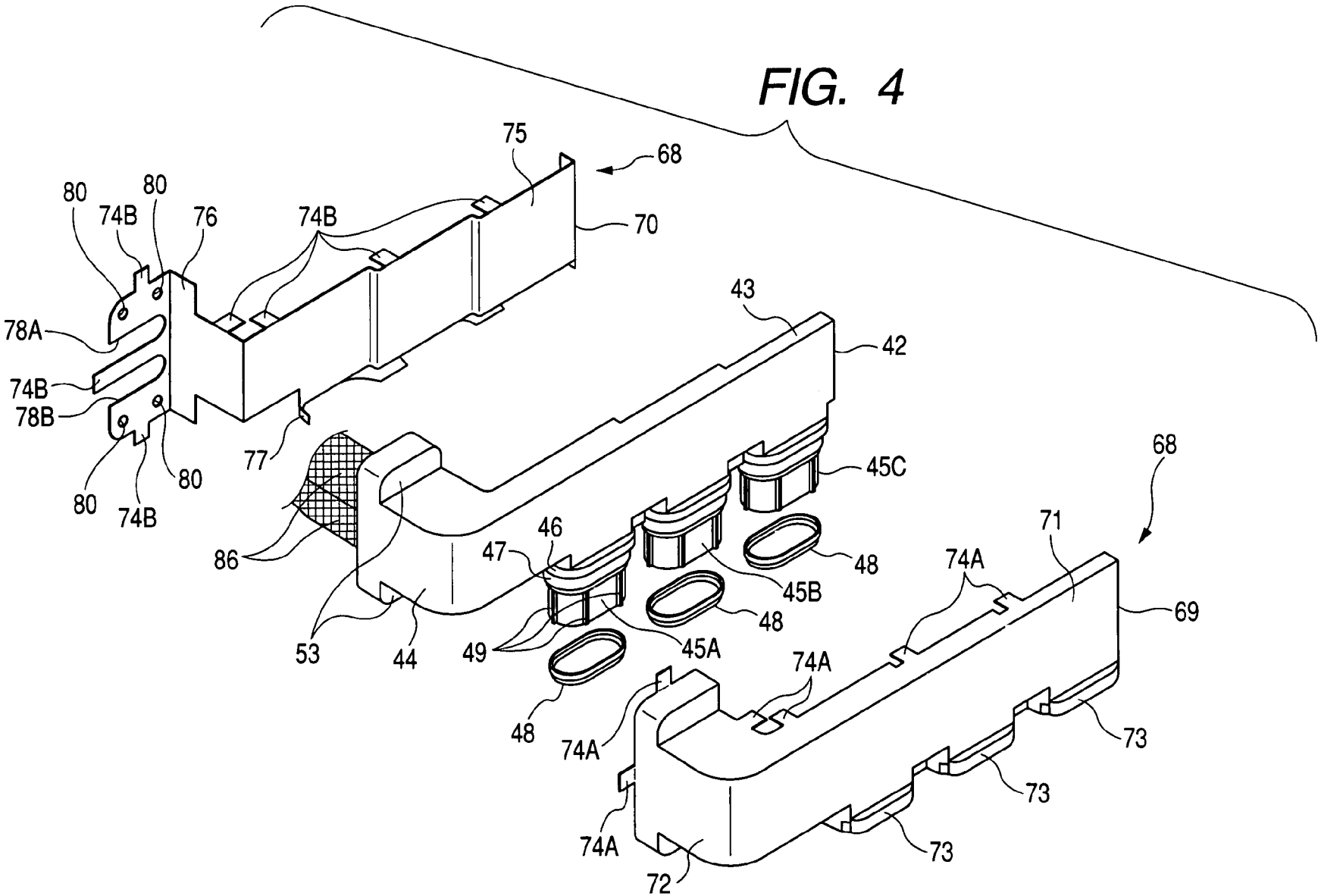
FIG. 4 is an exploded perspective view showing a wire-side connector shield shell and a wire-side connector housing.
Figure 5:
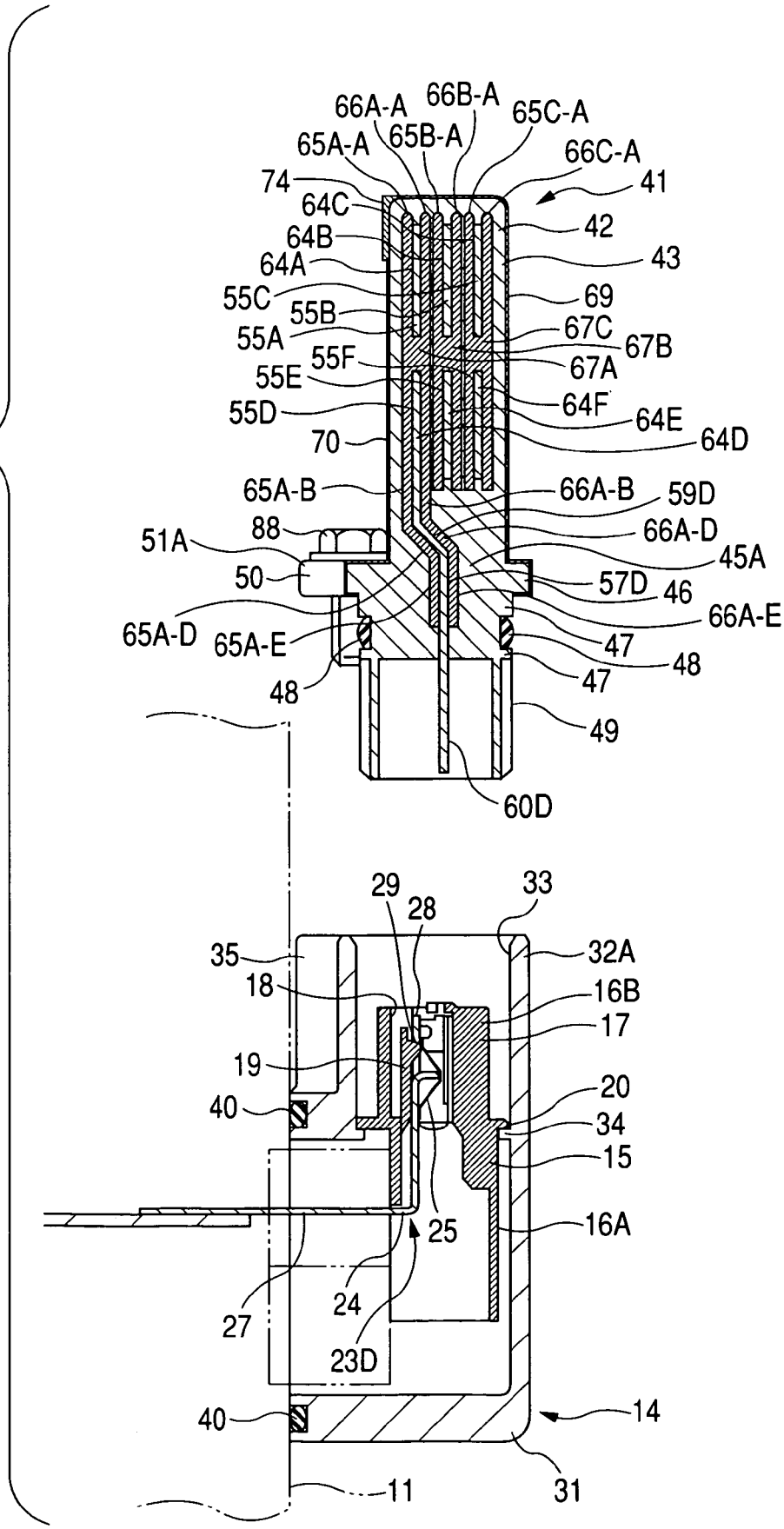
FIG. 5 is a vertical cross-sectional view showing the wire-side connector separated from the apparatus-side connector.
Figure 6:
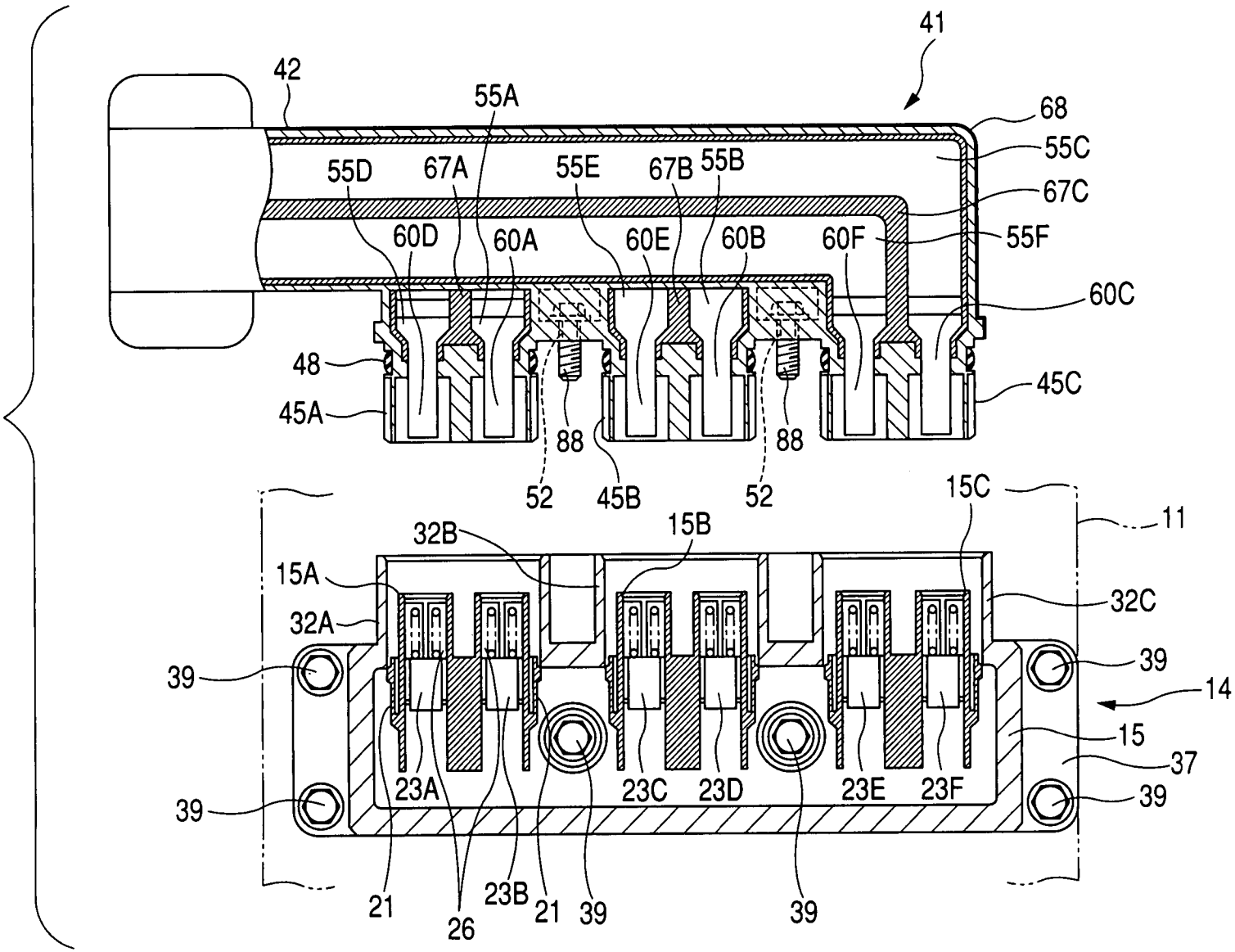
FIG. 6 is a transversal cross-sectional view showing the wire-side connector separated from the apparatus-side connector.
Figure 7:
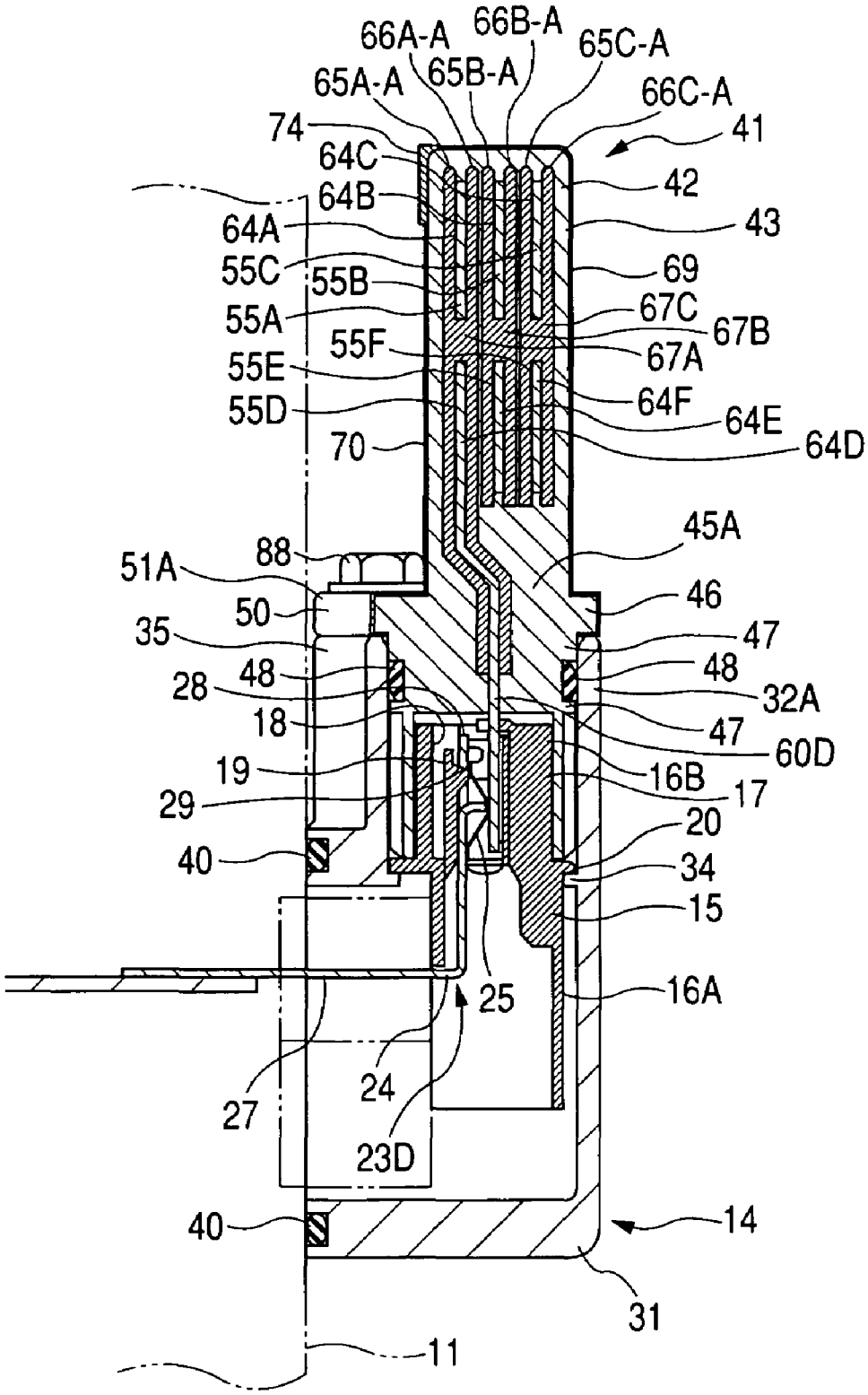
FIG. 7 is a vertical cross-sectional view showing the wire-side connector fitted to the apparatus-side connector.
Figure 8:
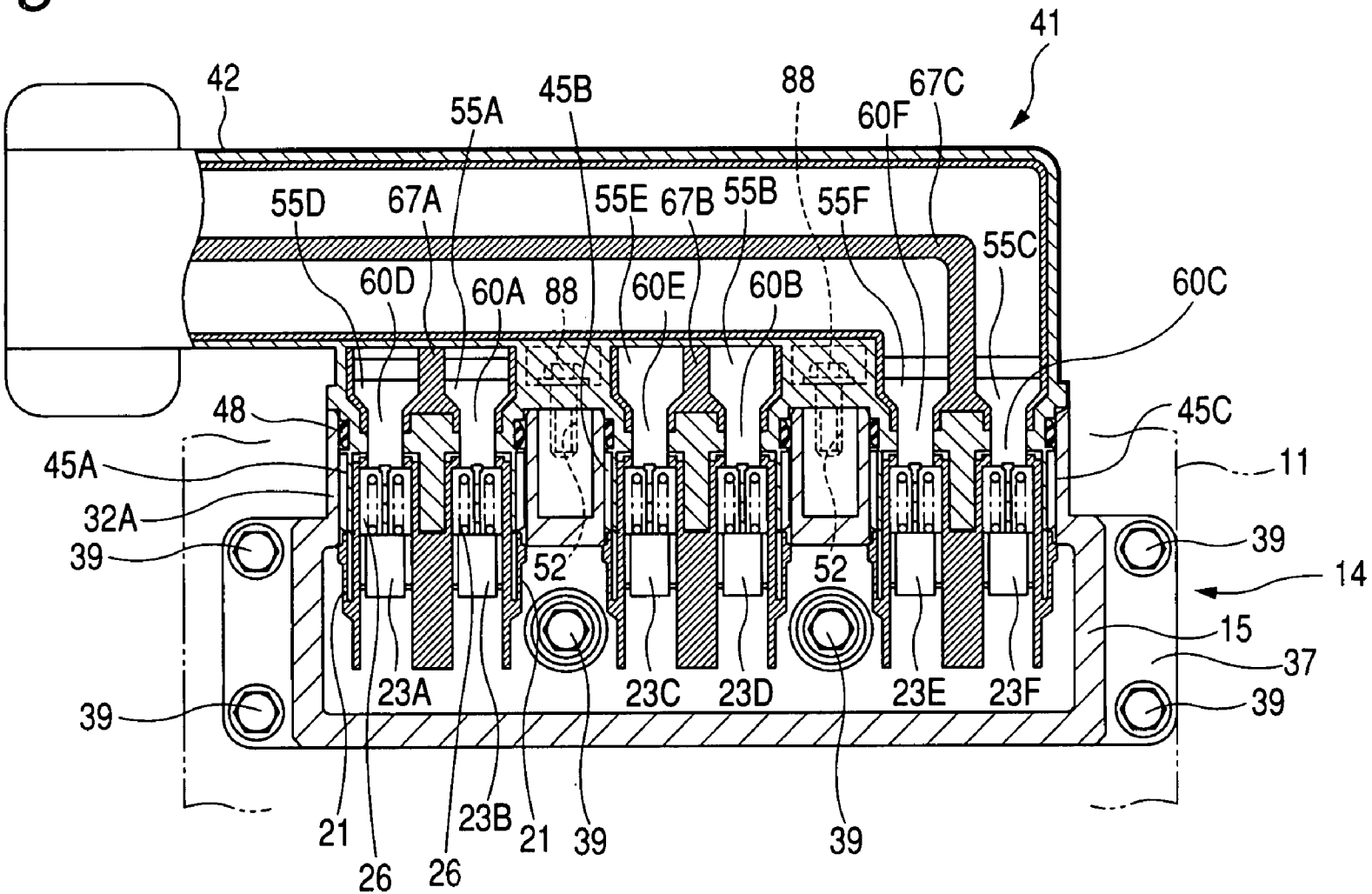
FIG. 8 is a transversal cross-sectional view showing the wire-side connector fitted to the apparatus-side connector.

Referring to the accompanying drawings, embodiments of the present invention will be described hereunder.

First Embodiment

A first embodiment of the present invention will be described according to FIG. 1 to FIG. 10. Hereinafter, the right-hand side of FIG. 1 will be defined as a front or forward side, and the left-hand side thereof as a rear or backward side.

[Inverter 10]

First, an inverter 10, to which an inverter connector 12 according to this embodiment is to be attached, will be described. The inverter 10 is constituted of an inverter main circuit (not shown) stored in a casing 11. The casing 11 is provided with a through hole (not shown) on a front face thereof for communication between inside and outside of the same. The casing 11 contains therein first to sixth output terminals arranged, a total of six output terminals (not shown), which are directly connected to the inverter main circuit (not shown) and aligned in a row in pairs respectively corresponding to U, V and W phases. The first and the second output terminals are output terminals of the U-phase; the third and the fourth output terminals are of the V-phase; and the fifth and the sixth output terminals are of the W-phase. These output terminals are exposed at the through hole (not shown) of the casing 11.

[Inverter Connector 12]

Next, the inverter connector 12 according to this embodiment will be described. The inverter connector 12 includes an apparatus-side connector 14 connected to the output terminals (not shown) of the inverter 10 and a wire-side connector 41 connected to a terminal portion of first to sixth wires 13A, 13B, 13C, 13D, 13E and 13F constituting a wire harness.

[Apparatus-Side Connector 14]

The apparatus-side connector 14 will be described first. The apparatus-side connector 14 is provided with first to third three apparatus-side connector housings 15A, 15B and 15C, and an apparatus-side connector shield shell 31 of a metal material enclosing an entire structure of the apparatus-side connector 14. The first to the third apparatus-side connector housings 15A to 15C are respectively provided with a couple of apparatus-side terminal fittings, i.e. a total of six of those as designated by 23A to 23F. Since the three apparatus-side connector housings 15A to 15C, as well as the six apparatus-side terminal fittings 23A to 23F are of an identical structure, these will be integrally referred to as the apparatus-side connector housing 15 and the apparatus-side terminal fitting 23 in the subsequent passage.

The apparatus-side connector shield shell 31 is made of a metal material, and of a rectangular box shape with a longitudinal side thereof horizontally oriented and having an opening on a rear face thereof. The apparatus-side connector shield shell 31 is provided with two attachment bases 37 and 37 horizontally protruding from a rear face thereof, and each of the attachment bases 37 and 37 is provided with two insertion holes 38A located close to its upper and lower end portions, through which the apparatus-side connector shield shell 31 can be screw-fixed to the casing 11. Further, the apparatus-side connector shield shell 31 is provided with two insertion holes 38B on a front face thereof, for screw-fixing the apparatus-side connector shield shell 31 to the casing 11. The apparatus-side connector shield shell 31 is fixed to the casing 11 with bolts 39 thread-fitted to the insertion holes 38A and 38B. A gap between the through hole (not shown) of the inverter 10 and the opening of the apparatus-side connector shield shell 31 is water tightly sealed with a seal ring 40.

On an upper face of the apparatus-side connector shield shell 31, first to third hood portions of a cylindrical shape having a substantially elliptical cross-section are disposed in a row as designated by 32A, 32B and 32C from the left, and a cavity 33 is formed in each of the hood portions 32A to 32C.

Inside the cavity 33, the apparatus-side connector housing 15 is set down from above. The apparatus-side connector housing 15 is made of a synthetic resin, and constituted of a lower cylindrical portion 16A having a substantially elliptical cross-section and a pair of terminal cylinders 16B disposed side by side, formed in a unified body. A retaining rib 20 is formed at an upper end portion of the lower cylindrical portion 16A so as to engage with a stopper 34 projecting from an inner wall of the cavity 33, thus to prevent the apparatus-side connector housing from dropping off. The lower cylindrical portion 16A is provided, on a front face and left and right lateral faces thereof, with three cantilever-shaped, upwardly extending flexible locking pieces 21 and protecting ribs 22 formed on both sides of each flexible locking piece 21. These flexible locking pieces 21 are to be engaged with a stopper (not shown) projecting from an inner wall of the cavity 33, thus to prevent the apparatus-side connector housing 15 from coming off upward.

The first apparatus-side connector housing 15A is set down in the cavity 33 of the first hood portion 32A; the second apparatus-side connector housing 15B in the cavity 33 of the second hood portion 32B; and the third apparatus-side connector housing 15C in the cavity 33 of the third hood portion 32C.

Each of the terminal cylinders 16B of the apparatus-side connector housing 15 is provided with a vertical rib on a front face thereof (to the right in FIG. 2), and a molded hole 18 of a square cylindrical shape slightly protruding backward from a rear face thereof (to the left in FIG. 2), and a cantilever-shaped, upwardly extending lance 19 is integrally formed inside the molded hole 18. An apparatus-side terminal fitting 23 is inserted into the terminal cylinder 16B from a lower portion thereof. The apparatus-side terminal fitting 23 is provided with a lance hole 29 (to be described later), which is to become engaged with the lance 19 once the apparatus-side terminal fitting 23 is inserted into thereby prevent the apparatus-side terminal fitting 23 from coming off (dropping) from the apparatus-side connector housing 15.

The first and the second apparatus-side terminal fittings 23A and 23B are retained in the first apparatus-side connector housing 15A and disposed side by side inside the cavity 33. Likewise, the third and the fourth apparatus-side terminal fittings 23C and 23D are retained in the second apparatus-side connector housing 15B and disposed side by side inside the cavity 33, and the fifth and the sixth apparatus-side terminal fittings 23E and 23F are retained in the third apparatus-side connector housing 15C and disposed side by side inside the cavity 33.

The apparatus-side terminal fittings 23 are formed substantially in an L-shape in a side view, and includes a terminal main body 24 of a thick plate material and an elastic contact piece 25, which is thinner than the terminal main body 24 and coupled thereto. The terminal main body 24 includes a female connection portion 26 and an extension 27 downwardly extending from the female connection portion 26 and bent backward substantially at right angles. The female connection portion 26 is vertically disposed in a square-cylindrical shape with open ends, and a lance hole 29 is provided on a rear face 28 of the female connection portion 26, to be engaged with the lance 19 in the terminal cylinder 16B to thereby prevent the apparatus-side terminal fitting 23 from coming off (dropping). At an end portion of the extension 27, a vertically penetrating circular hole 30 is provided.

The circular hole 30 of the first apparatus-side terminal fitting 23A is fixed to the first output terminal (not shown) of the inverter 10, and the circular hole 30 of the second apparatus-side terminal fitting 23B is fixed to the second output terminal (not shown). Likewise, the circular hole 30 of the third apparatus-side terminal fitting 23C is fixed to the third output terminal (not shown), and the circular hole 30 of the fourth apparatus-side terminal fitting 23D is fixed to the fourth output terminal (not shown). And the circular hole 30 of the fifth apparatus-side terminal fitting 23E is fixed to the fifth output terminal (not shown), and the circular hole 30 of the sixth apparatus-side terminal fitting 23F is fixed to the sixth output terminal (not shown).

Since the first and the second output terminals correspond to the U-phase of the inverter 10, the first and the second apparatus-side terminal fittings 23A and 23B disposed side by side also correspond to the U-phase. Likewise, since the third and the fourth output terminals correspond to the V-phase of the inverter 10, the third and the fourth apparatus-side terminal fittings 23C and 23D disposed side by side also correspond to the V-phase. And since the fifth and the sixth output terminals correspond to the W-phase of the inverter 10, the fifth and the sixth apparatus-side terminal fittings 23E and 23F disposed side by side also correspond to the W-phase.

A cylindrical screw inlet 35 having a vertical axial line is located at a backward position in a region between the first hood portion 32A and the second hood portion 32B, as well as at a backward position in a region between the second hood portion 32B and the third hood portion 32C. These screw inlets 35 are provided with a screw hole 36 penetrating therethrough in a vertical direction, for screw-fixing the apparatus-side connector 14 and the wire-side connector 41.

[Wire-Side Connector 41]

The wire-side connector 41 will now be described. The wire-side connector 41 is constituted of a wire-side connector housing 42 made of a synthetic resin, enclosed as a whole by a wire-side connector shield shell 68 of a metal material and a first and a second wire-side shield shells 81A and 81B. The wire-side connector housing 42 includes first to sixth six busbars 55A, 55B, 55C, 55D, 55E, 55F and first to third three separators 63A, 63B and 63C holding there among the busbars 55A to 55F, integrally formed by molding.

[Wire-Side Connector Housing 42]

The wire-side connector housing 42 is made of a synthetic resin, formed in a bent shape so as to fit a corner of substantially right angles from a front face to a left side face of the casing 11 of the inverter 10. The wire-side connector housing 42 includes a busbar storage portion 43 substantially of a plate shape to confront a front face of the casing 11, a wire connection section 44 substantially of a rectangular parallelepiped shape to confront a left side face of the casing 11, and a first to a third fitting portion 45A, 45B and 45C of a cylindrical shape having an elliptical cross-section, downwardly projecting side by side from a lower face of the busbar storage portion 43, which are designated as the first fitting portion 45A, the second fitting portion 45B and the third fitting portion 45C from the left.

The fitting portions 45A to 45C are respectively provided with a base portion 46 protruding from an upper portion thereof along its outer circumference, and a pair of seal ring retaining ribs 47 formed along its outer circumference below the base portion 46, and an elliptical shape seal ring 48 is attached between the seal ring retaining ribs 47. On an outer circumferential surface below the seal ring retaining ribs 47 of the fitting portions 45A to 45C, six ribs 49 are formed in a vertical direction. The three base portions 46 of the fitting portions 45A to 45C are connected behind the busbar storage portion 43 to thereby constitute a base plane 50. The base plane 50 is provided with a first attaching base 51A, backwardly protruding therefrom in a semicircular shape to form a circular shape as a whole, between the first fitting portion 45A and the second fitting portion 45B, and an insertion hole 52 vertically penetrating through the first attaching base 51A, for screw-fixing the apparatus-side connector 14 and the wire-side connector 41. Likewise, the base plane 50 is also provided with a second attaching base 51B, slightly protruding from backward to form a circular shape as a whole, between the second fitting portion 45B and the third fitting portion 45C, and an insertion hole 52 vertically penetrating through the second attaching base 51B, for screw-fixing the apparatus-side connector 14 and the wire-side connector 41.

Figure 9:
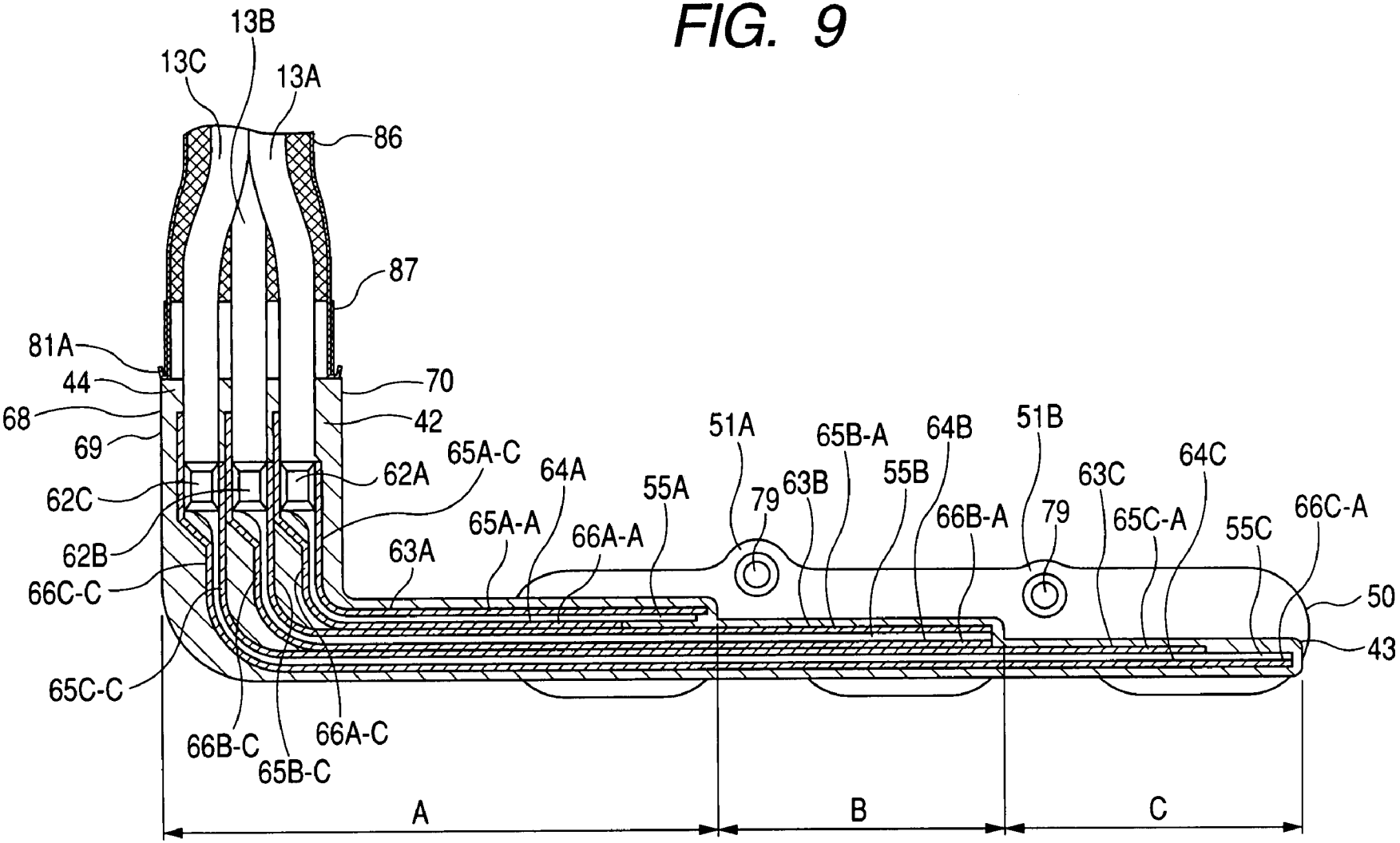
FIG. 9 is a horizontal cross-sectional view showing the wire-side connector.
Figure 10:
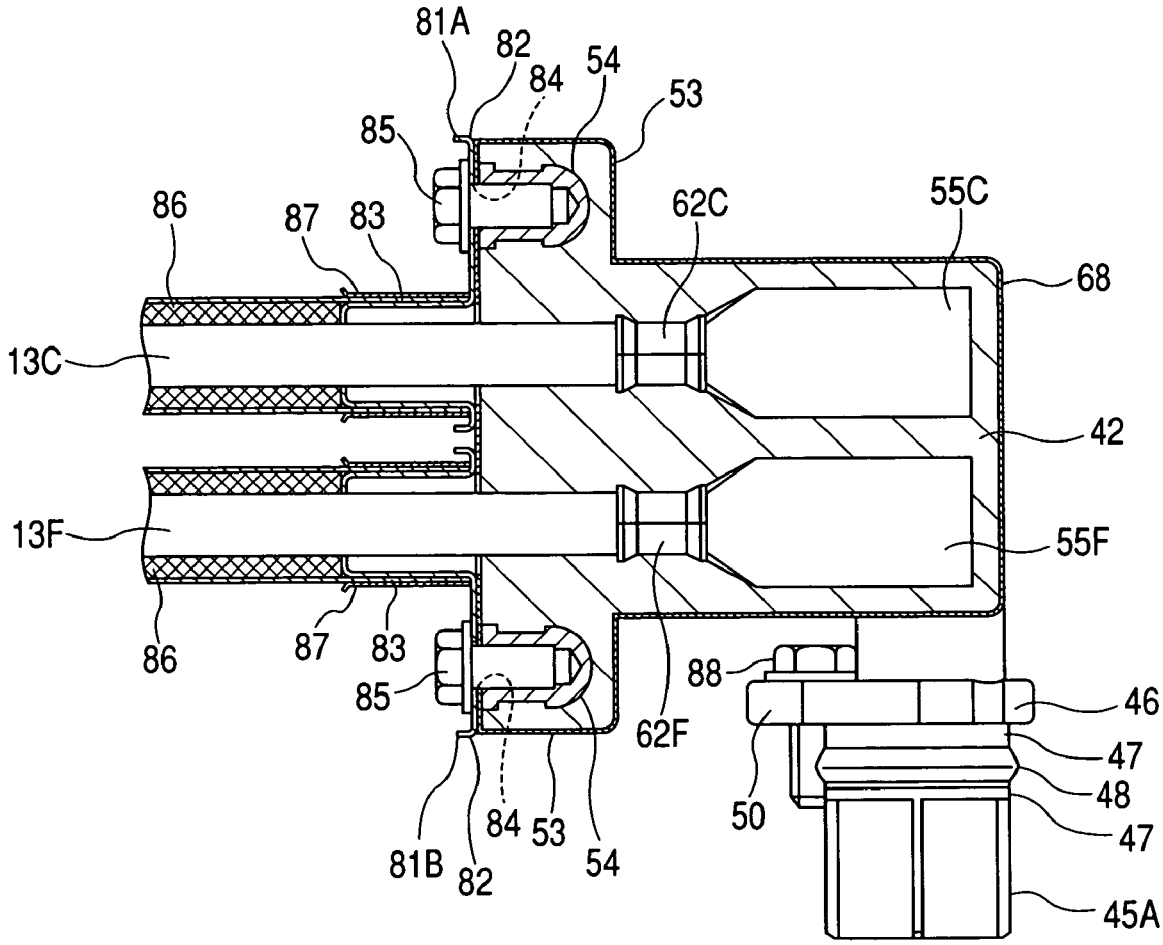
FIG. 10 is a vertical cross-sectional view showing a wire connection section of the wire-side connector.
Figure 11:
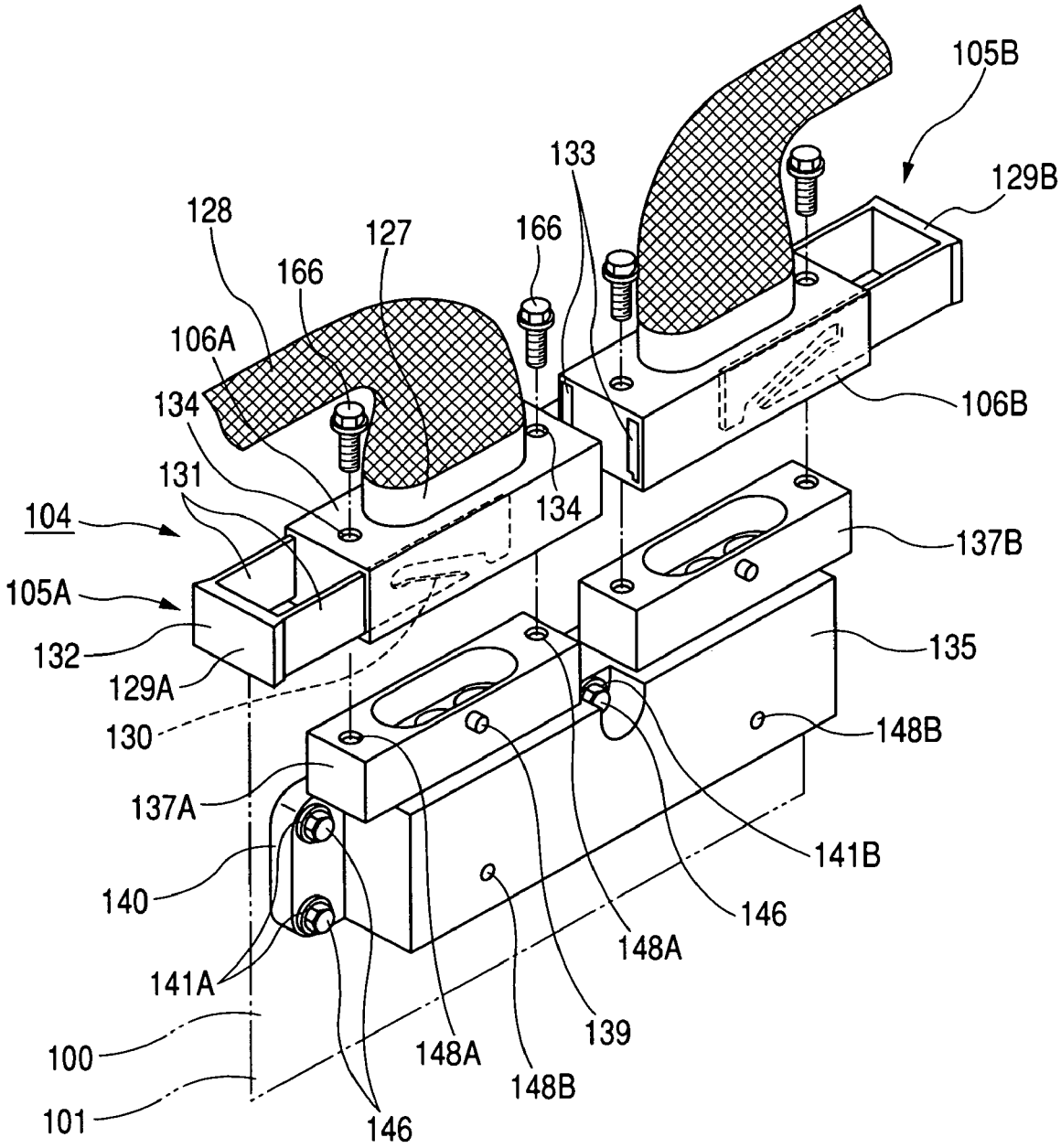
FIG. 11 is a perspective view showing a wire-side connector separated from an apparatus-side connector, according to the second embodiment.
Figure 12:
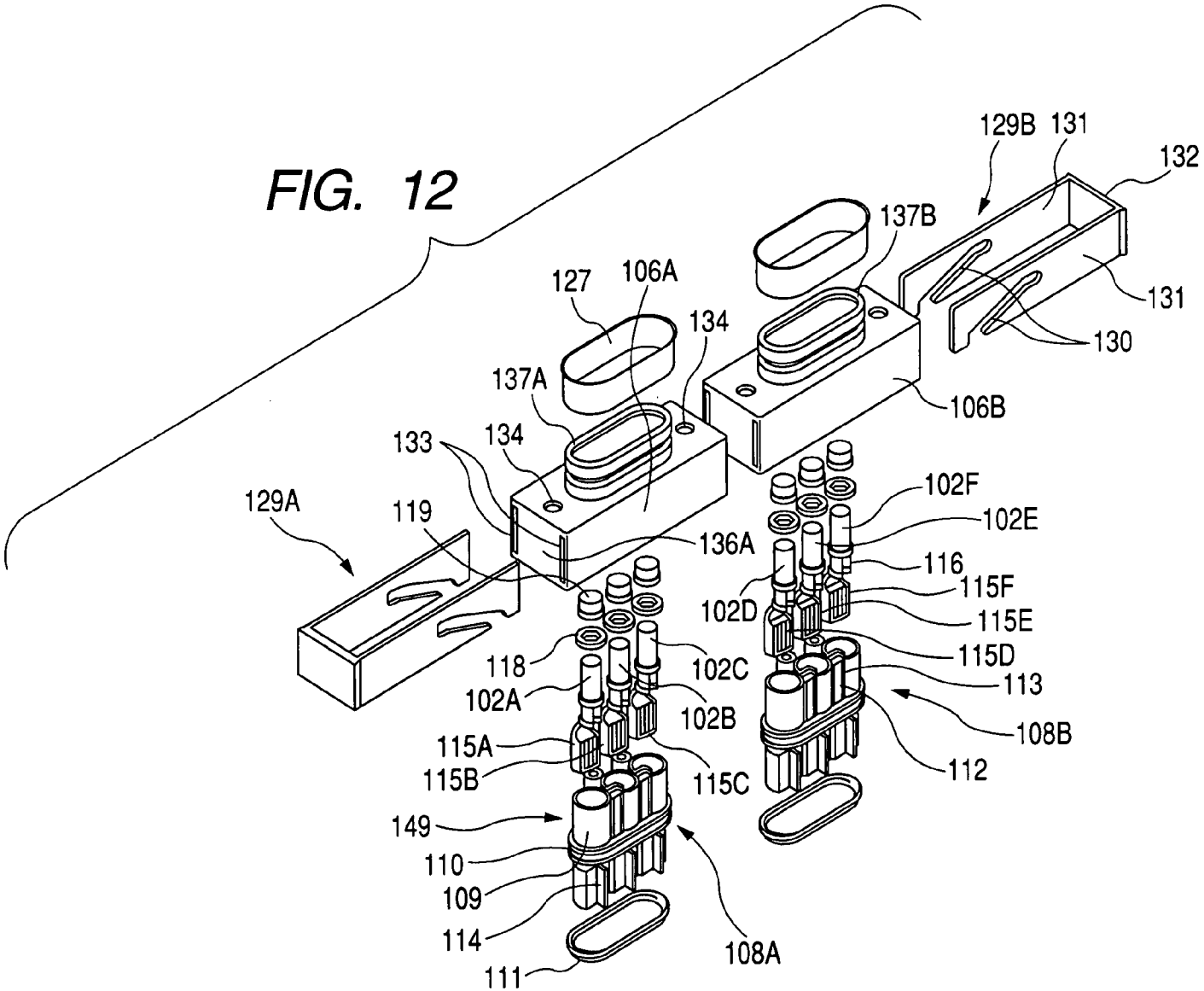
FIG. 12 is an exploded perspective view showing the wire-side connector.
Figure 13:
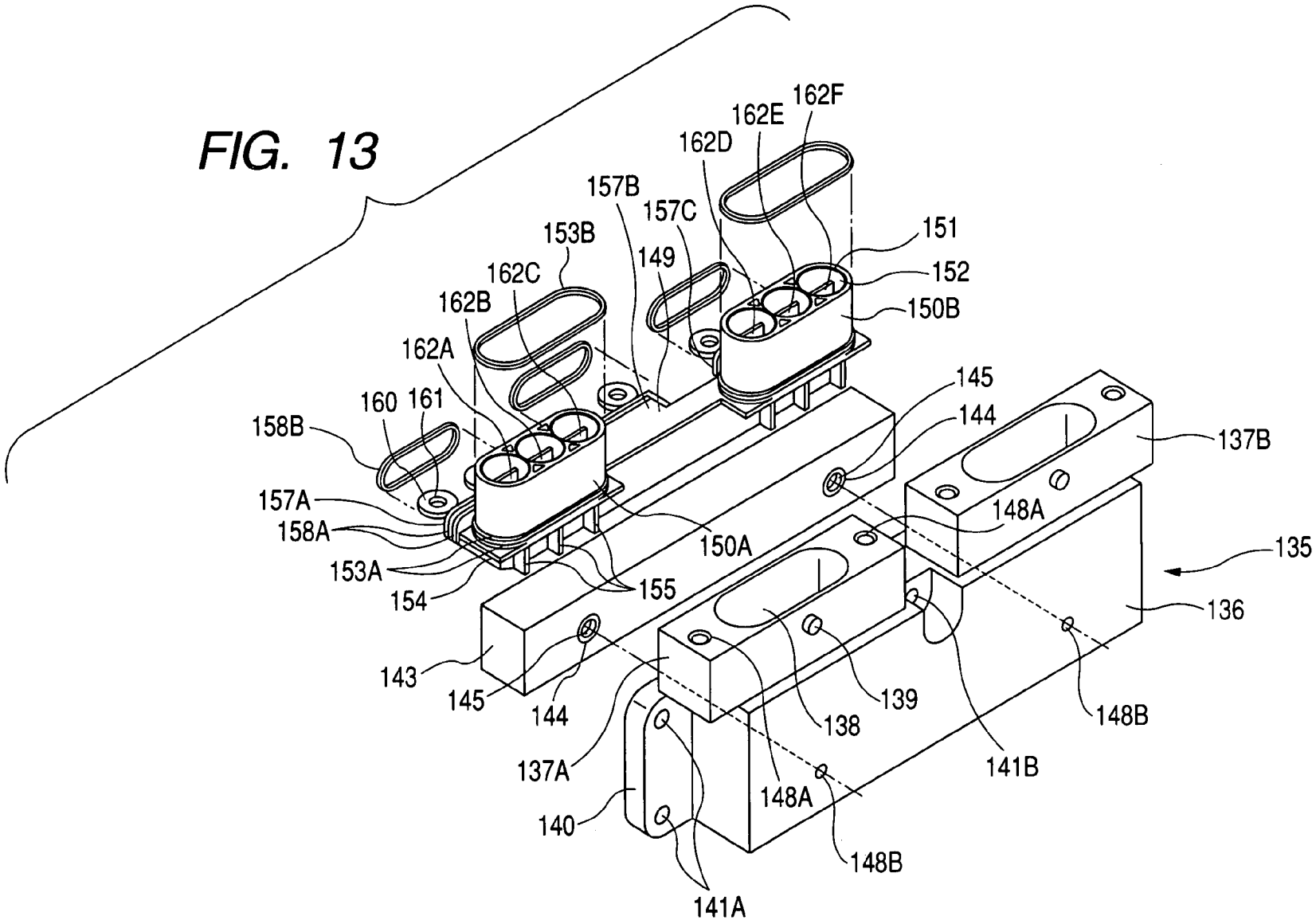
FIG. 13 is an exploded perspective view showing the apparatus-side connector.
Figure 14:
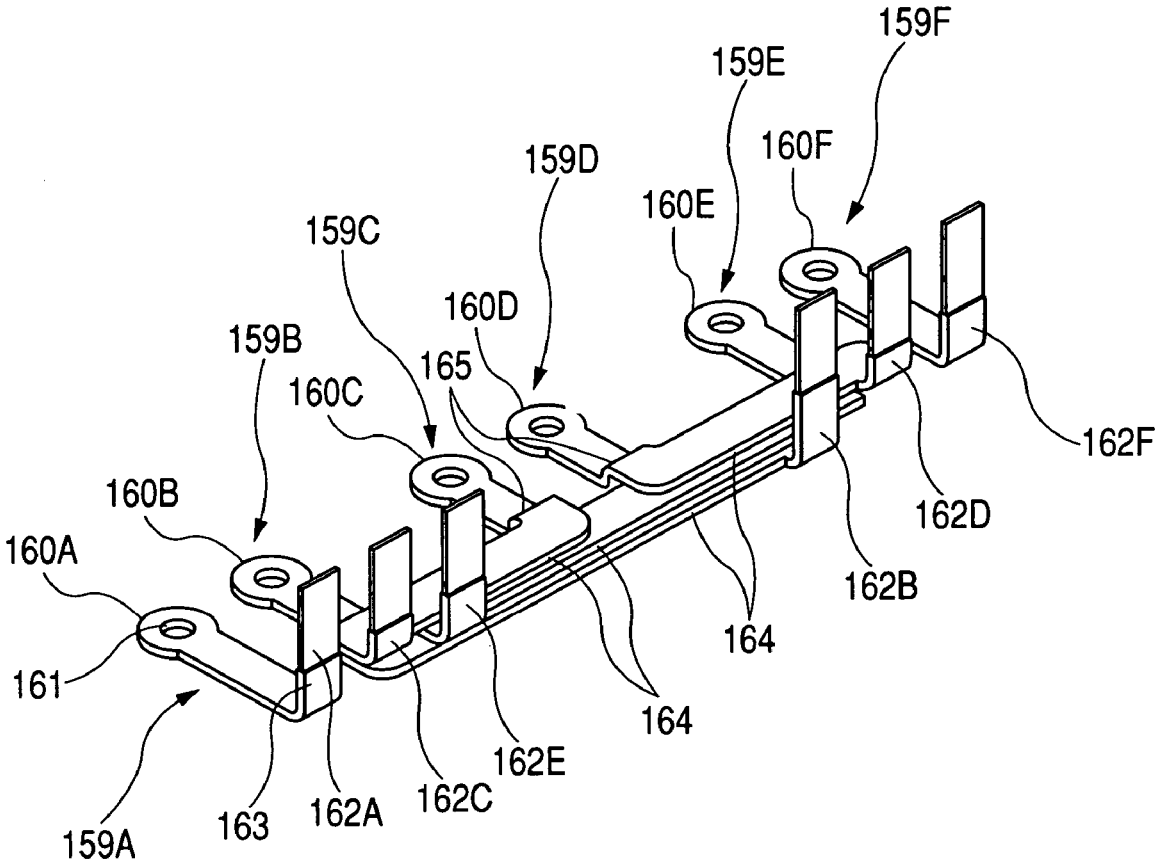
FIG. 14 is a perspective view showing busbars.
Figure 15:
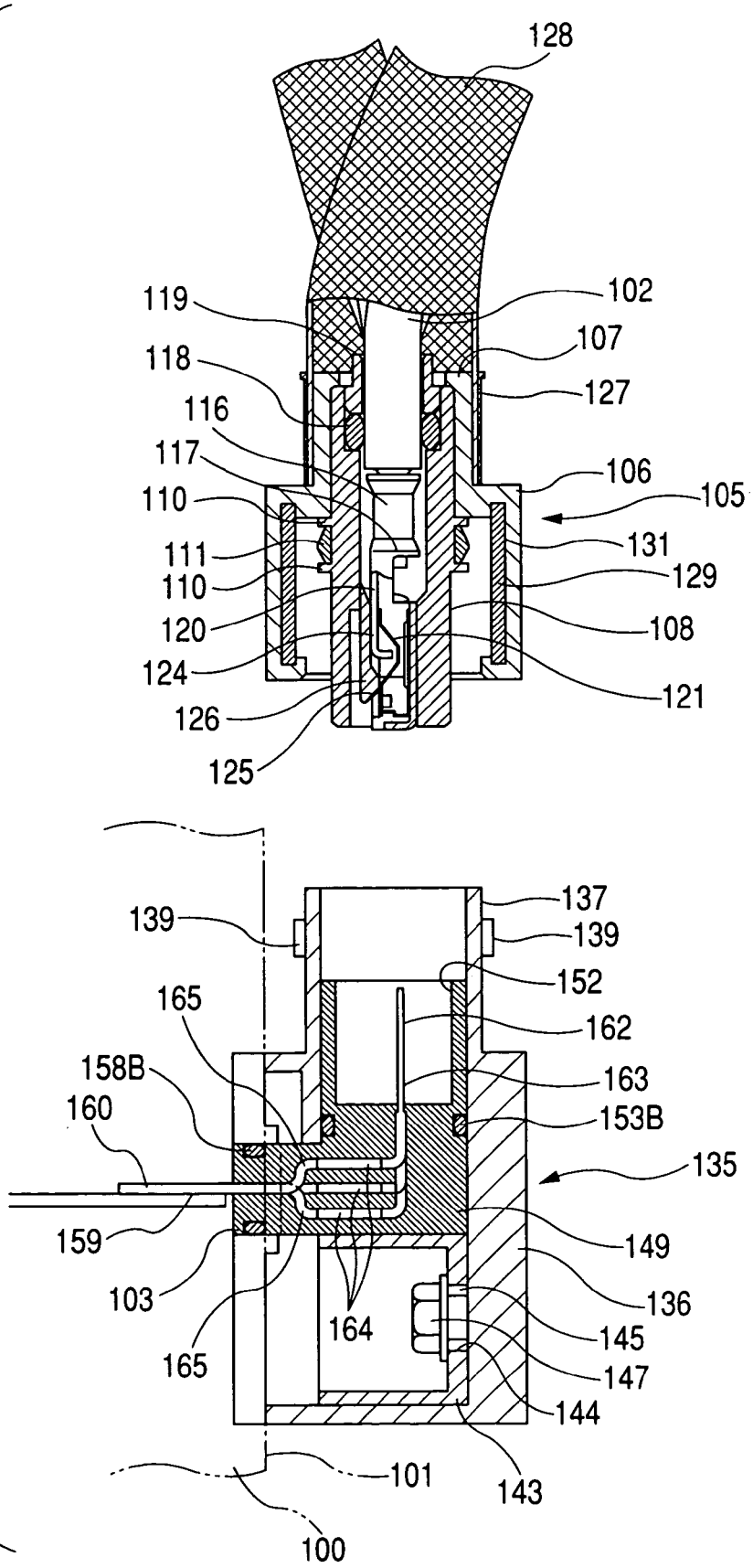
FIG. 15 is a vertical cross-sectional view showing the wire-side connector separated from the apparatus-side connector.
Figure 16:
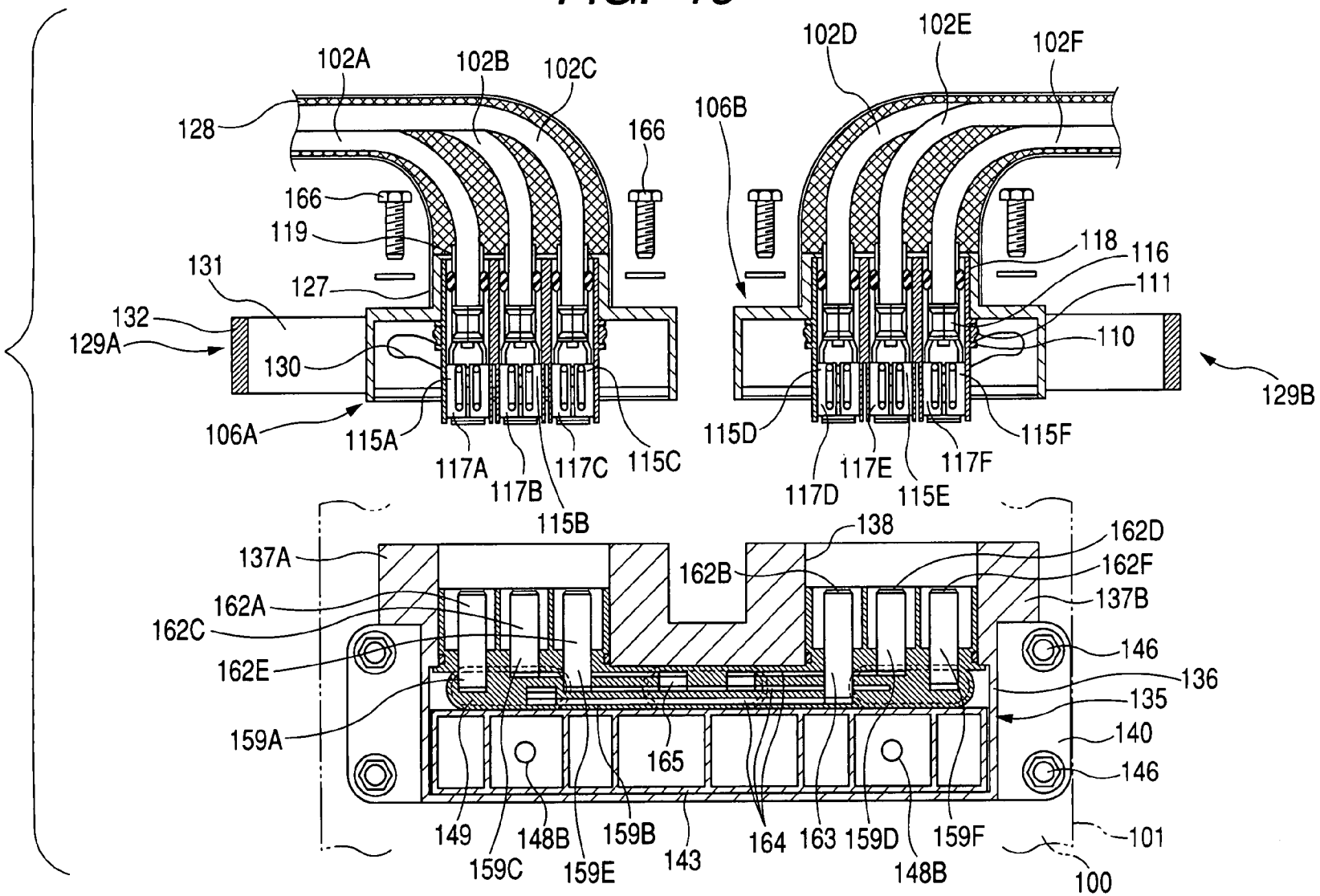
FIG. 16 is a transversal cross-sectional view showing the wire-side connector separated from the apparatus-side connector.
Figure 17:
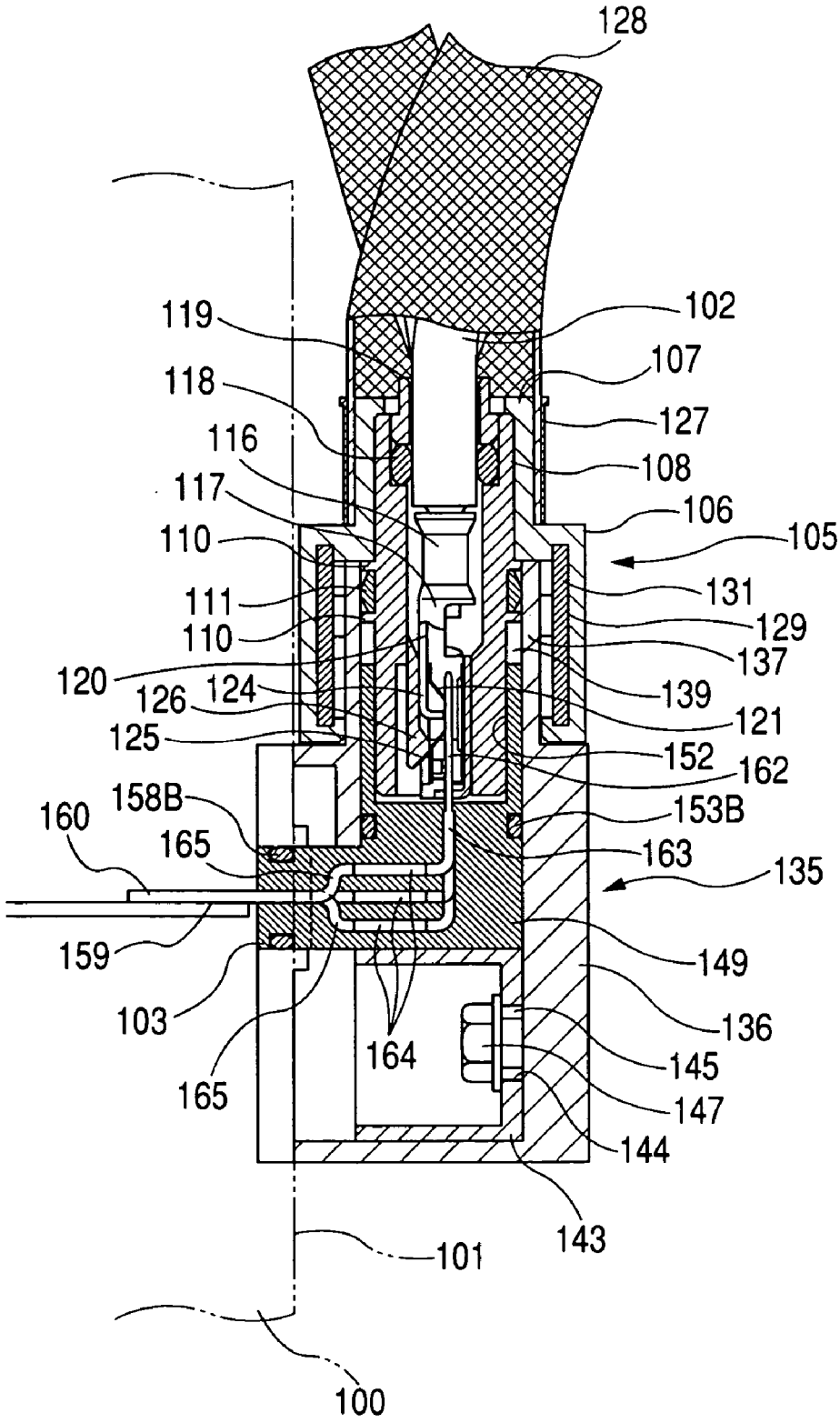
FIG. 17 is a vertical cross-sectional view showing the wire-side connector fitted to the apparatus-side connector.
Figure 18:
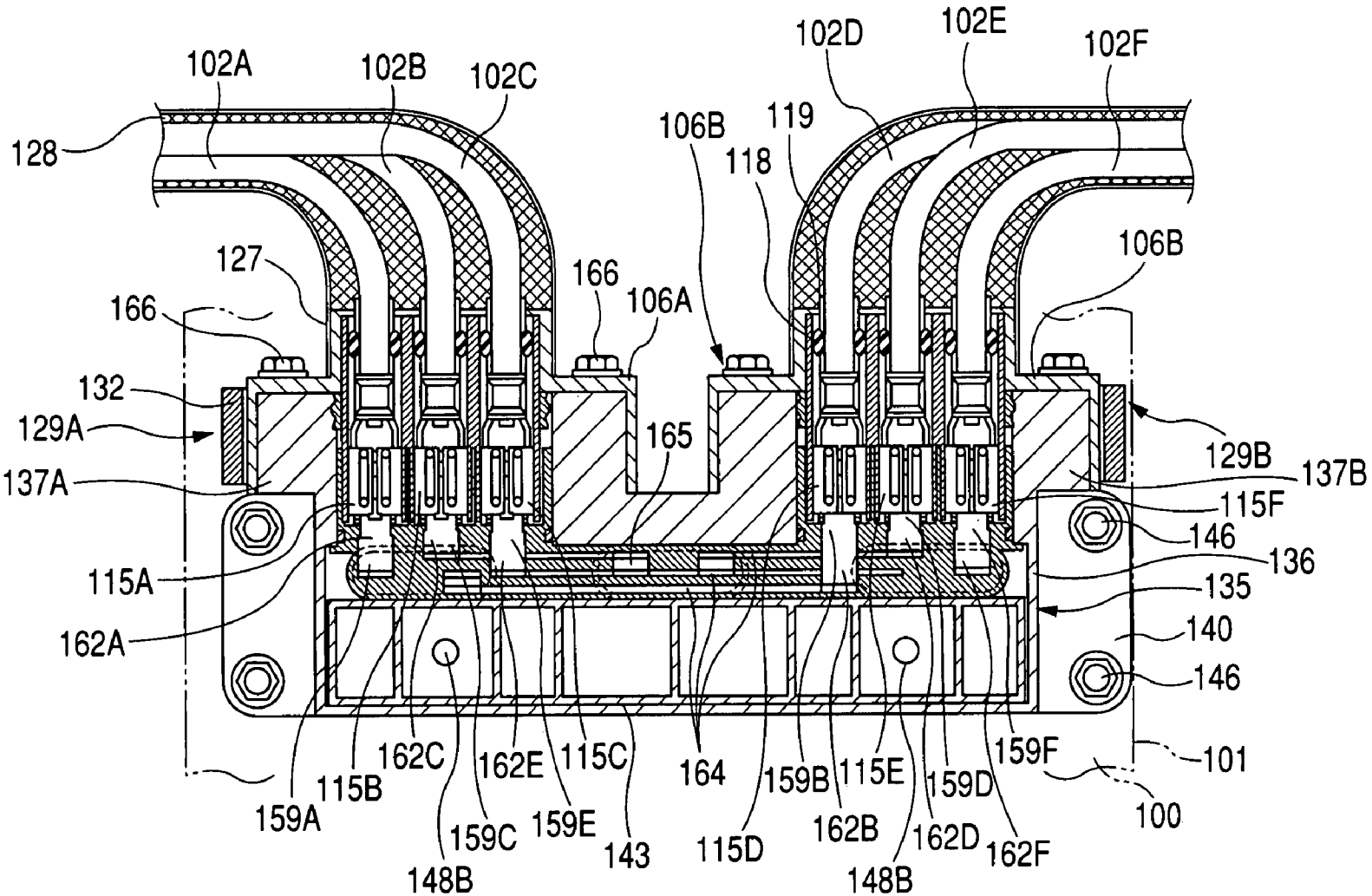
FIG. 18 is a transversal cross-sectional view showing the wire-side connector fitted to the apparatus-side connector.
Figure 19:
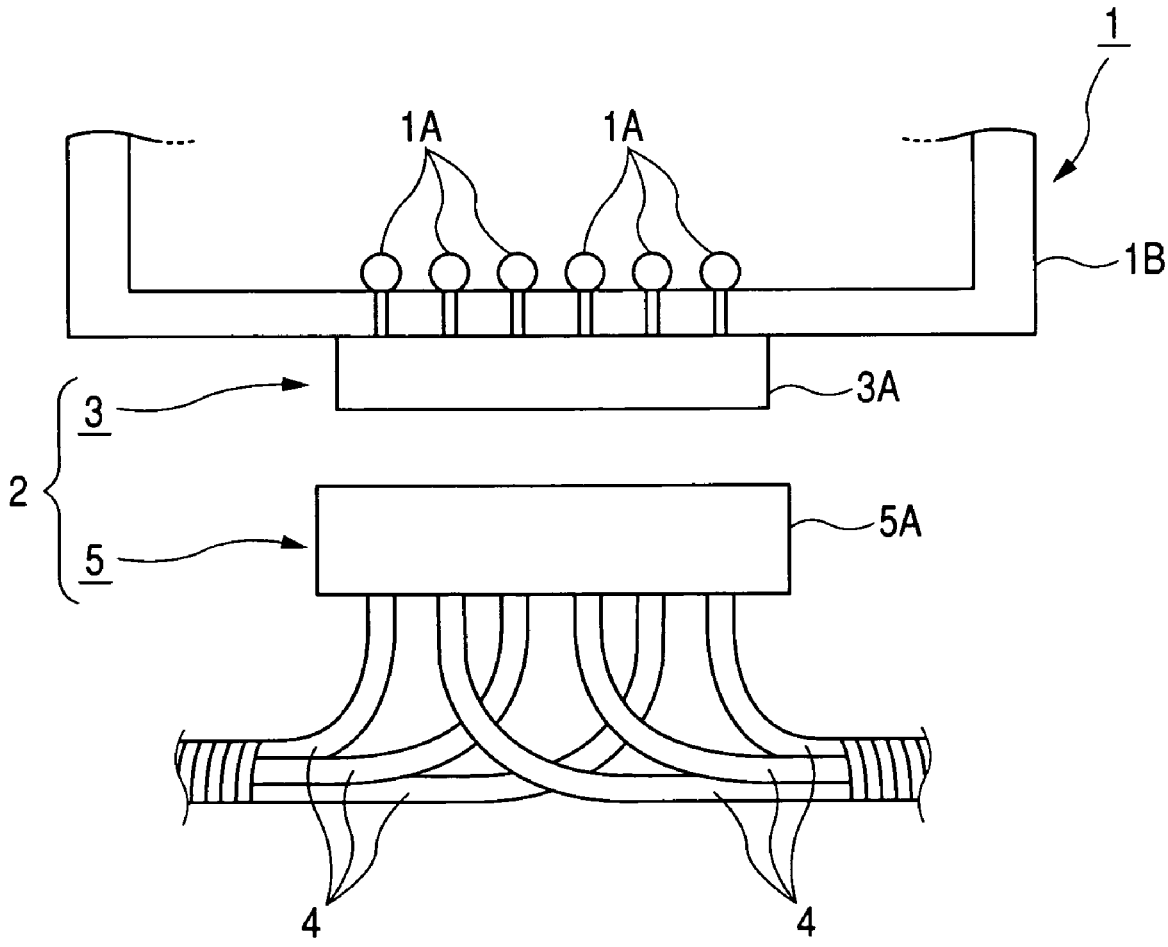
FIG. 19 is a schematic plan view showing a conventional inverter connector.

The busbar storage portion 43, which is to confront a front face of the casing 11, is formed such that a thickness thereof in a back and forth direction is gradually reduced from the left side toward the right, and more specifically, a region A from a left side end portion of the busbar storage portion 43 to a right side end portion of the first fitting portion 45A is the thickest; a region B from the right side end portion of the first fitting portion 45A to the right side end portion of the second fitting portion 45B is thinner than the region A; and a region C from the right side end portion of the second fitting portion 45B to a right side end portion of the busbar storage portion 43 is thinner than the region B (See FIG. 9).

The wire connection section 44, which is to confront a left side face of the casing 11, is substantially of a rectangular parallelepiped shape and provided with wire-side shield shell attaching bases 53 and 53, one upwardly and the other downwardly projecting from a rear edge thereof. At each of the four corners of the wire-side shield shell attaching bases 53 and 53, a cap nut 54 is buried with its opening facing backward in the wire-side connector housing 42 by insert-molding, for screw-fixing the wire-side connector shield shell 68 and the wire-side shield shells 81A and 81B.

Out of a rear face of the wire connection section 44, first to sixth wires 13A to 13F are led out in an upper and lower two lines, each of which includes three horizontally aligned wires, and extending backward. In the upper line the first wire 13A, the second wire 13B and the third wire 13C are sequentially aligned from the right, while the fourth wire 13D, the fifth wire 13E and the sixth wire 13F are sequentially aligned from the right in the lower line.

[Wire-Side Connector Shield Shell 68]

The wire-side connector shield shell 68 is made of a conductive thin plate material, and constituted of two separate members namely an outer shell 69 and an inner shell 70.

The outer shell 69 includes a front horizontal shell 71 to cover a front face, upper and lower faces and a right side face of the busbar storage portion 43 of the wire-side connector housing 42; a wire connection section shell 72 to cover a left side face, upper and lower faces of the wire connection section 44 of the wire-side connector housing 42; and a fitting portion shell 73 to cover a front face and left and right side faces of the base portion 46 of the fitting portion 45 of the wire-side connector housing 42.

The inner shell 70 includes a rear horizontal shell 75 to cover a rear face of the busbar storage portion 43 of the wire-side connector housing 42; a wire connection section inner shell 76 to cover a right side face and a rear face of the wire connection section 44 of the wire-side connector housing 42; and a fitting portion inner shell 77 to cover a rear face and a left and right side faces of the base portion 46 of the fitting portion 45 of the wire-side connector housing 42.

The outer shell 69 is provided with a plurality of plate-shape fixing lugs 74A along a perimetrical edge thereof, and the inner shell 70 is also provided with a plurality of plate-shape fixing lugs 74B at positions corresponding to the fixing lugs 74A. The outer shell 69 and the inner shell 70 are combined to the wire-side connector housing 42 from forward and backward directions respectively such that the fixing lugs 74 of the outer shell 69 are superposed on the fixing lugs 74B of the inner shell 70, and both fixing lugs are bent together substantially by right angles toward the confronting side of the inverter 10 of the inner shell 70 confronting the casing 11 so that the fixing lugs 74B of the inner shell 70 are held between the fixing lugs 74A of the outer shell 69 and a rear face of the inner shell 70, to be thereby combined with the fixing lugs 74A and constitute fixing lugs 74. In this way the outer shell 69 and the inner shell 70 constitute the wire-side connector shield shell 68, which is assembled so as to enclose the wire-side connector housing 42.

The fitting portion inner shell 77 of the inner shell 70 is provided with two insertion holes 79 and 79 vertically penetrating therethrough, at positions corresponding to the insertion holes 52 and 52 located on the first and the second attaching bases 51A and 51B of the wire-side connector housing 42, for screw-fixing the apparatus-side connector 14 and the wire-side connector 41.

A rear face portion of the wire connection section inner shell 76 of the inner shell 70 is basically of a rectangular shape, and provided with a first guide groove 78A horizontally formed with an opening on the left side at a position slightly above a center thereof, through which the first to the third wires 13A to 13C are led out backward. Also, a second guide groove 78B is horizontally formed with an opening on the left side at a position slightly below a center of the rear face portion of the wire connection section inner shell 76, and the fourth to the sixth wires 13D to 13F are led out backward through the guide groove 78B.

At the four corners of the rear face portion of the wire connection section inner shell 76, a total of four insertion holes 80, 80, 80 and 80 are provided for fixing the wire-side shield shells 81A and 81B (to be described later), such that positions of the insertion holes 80 correspond to those of the cap nuts 54 buried in the wire-side connector housing 42.

The first wire-side shield shell 81A is made of a conductive thin plate material, and includes a base plate 82 of a substantially rectangular shape and a cylindrical fitting portion 83 having a substantially elliptical cross-section backwardly projecting from a longitudinal edge of the base plate 82. Through the fitting portion 83, the first to the third wires 13A to 13C backwardly projecting from the wire-side connector 41 are inserted. At two corners close to a longitudinal edge of the base plate 82 opposite the fitting portion 83, two insertion holes 84 and 84 are provided for screw-fixing the wire-side connector shield shell 68, and the first wire-side shield shell 81A and the wire-side connector shield shell 68 are overlapping such that the insertion hole 84 and 84 and the cap nut 54 and 54 meet each other. A bolt 85 is inserted from a backward direction through the insertion holes 84 and 84 of the first wire-side shield shell 81A and the insertion holes 80 and 80 of the wire-side connector shield shell 68, to be thread-fitted and fastened with the cap nut 54 and 54 of the wire-side connector housing 42, to thereby fix the first wire-side shield shell 81A to the wire-side connector shield shell 68. Under such a structure, the first to the third wires 13A to 13C are backwardly led out in a group from the wire-side connector 41.

Likewise, the second wire-side shield shell 81B is made of a conductive thin plate material, and includes a base plate 82 of a substantially rectangular shape and a cylindrical fitting portion 83 having a substantially elliptical cross-section backwardly projecting from a longitudinal edge of the base plate 82. Through the fitting portion 83, the fourth to the sixth wires 13D to 13F backwardly projecting from the wire-side connector 41 are inserted. At two corners close to a longitudinal edge of the base plate 82 opposite the fitting portion 83, two insertion holes 84 and 84 are provided for screw-fixing the wire-side connector shield shell 68, and the second wire-side shield shell 81B and the wire-side connector shield shell 68 are overlapping such that the insertion hole 84 and 84 and the cap nut 54 and 54 meet each other. A bolt 85 is inserted from a backward direction through the insertion holes 84 and 84 of the second wire-side shield shell 81B and the insertion holes 80 and 80 of the wire-side connector shield shell 68, to be thread-fitted and fastened with the cap nut 54 of the wire-side connector housing 42, to thereby fix the second wire-side shield shell 81B to the wire-side connector shield shell 68. Under such a structure, the fourth to the sixth wires 13D to 13F are backwardly led out in a group from the wire-side connector 41.

The first to the third wires 13A to 13C are integrally shielded by a cylindrical shielding material 86 constituted of a meshed fine metal wire. A front end portion of the shielding material 86 is swaged to the fitting portion 83 of the first wire-side shield shell 81A, with a swaging ring 87. Likewise, the fourth to the sixth wires 13D to 13F are integrally shielded by a cylindrical shielding material 86 constituted of a meshed fine metal wire, and a front end portion of the shielding material 86 is swaged to the fitting portion 83 of the second wire-side shield shell 81B, with a swaging ring 87. As a result of such an arrangement, the shielding material 86, the first and the second wire-side shield shells 81A and 81B and the wire-side connector shield shell 68 are electrically connected.

The first wire 13A is connected to a U-phase of a first motor (not shown); the second wire 13B to a V-phase of the first motor (not shown); and the third wire 13C to a W-phase of the first motor (not shown). By contrast, the fourth wire 13D is connected to a U-phase of a second motor (not shown); the fifth wire 13E to a V-phase of the second motor (not shown); and the sixth wire 13F to a W-phase of the second motor (not shown).

[Busbars 55A, 55B, 55C, 55D, 55E, 55F]

Now, the first to the sixth busbars 55A, 55B, 55C, 55D, 55E and 55F are made of a conductive slender plate material and formed by a bending process in different lengths and configurations of end portions. Here below, the structure of each of the busbars 55A, 55B, 55C, 55D, 55E and 55F will be described.

The first busbar 55A includes a horizontal portion 56A having a vertically oriented and horizontally extending plane surface; a vertical portion 57A vertically extending downward from a right end portion of the horizontal portion 56A; and a wire connection portion 58A extending backward from a left end portion of the horizontal portion 56A. The vertical portion 57A is provided with an inclined portion 59A obliquely extending in a downward-forward direction from a substantially central portion thereof, and a terminal fitting portion 60A narrower than the inclined portion 59A and vertically extending downward from a lower end portion of the inclined portion 59A. A seal ring 61A is adhered around an upper end portion of the terminal fitting portion 60A. Also, a crimp portion 62A is provided at an end portion of the wire connection portion 58A, where the first wire 13A is crimped to the first busbar 55A by swaging the crimp portion 62A.

The second busbar 55B includes a horizontal portion 56B having a vertically oriented and horizontally extending plane surface, which is longer than the horizontal portion 56A of the first busbar 55A; a vertical portion 57B vertically extending downward from a right end portion of the horizontal portion 56B; and a wire connection portion 58B extending backward from a left end portion of the horizontal portion 56B and longer than the wire connection portion 58A of the first busbar 55A. The vertical portion 57B is provided with a terminal fitting portion 60B narrower than an upper end portion thereof and extending downward from a lower end portion thereof, such that its lowermost edge is aligned with that of the terminal fitting portion 60A of the first busbar 55A. A seal ring 61B is adhered around an upper end portion of the terminal fitting portion 60B. Also, a crimp portion 62B is provided at an end portion of the wire connection portion 58B, where the second wire 13B is crimped to the second busbar 55B by swaging the crimp portion 62B.

The third busbar 55C includes a horizontal portion 56C having a vertically oriented and horizontally extending plane surface, which is longer than the horizontal portion 56B of the second busbar 55B; a vertical portion 57C vertically extending downward from a right end portion of the horizontal portion 56C; and a wire connection portion 58C extending backward from a left end portion of the horizontal portion 56C and longer than the wire connection portion 58B of the second busbar 55B. The vertical portion 57C is provided with an inclined portion 59C obliquely extending in a downward-backward direction from a substantially central portion thereof, and a terminal fitting portion 60C narrower than the inclined portion 59C and vertically extending downward from a lower end portion of the inclined portion 59C, such that its lowermost edge is aligned with that of the terminal fitting portion 60A of the first busbar 55A. A seal ring 61C is adhered around an upper end portion of the terminal fitting portion 60C. Also, a crimp portion 62C is provided at an end portion of the wire connection portion 58C, where the third wire 13C is crimped to the third busbar 55C by swaging the crimp portion 62C.

The fourth busbar 55D includes a horizontal portion 56D having a vertically oriented and horizontally extending plane surface, which is shorter than the horizontal portion 56A of the first busbar 55A; a vertical portion 57D vertically extending downward from a right end portion of the horizontal portion 56D and shorter than the vertical portion 57A of the first busbar 55A; and a wire connection portion 58D extending backward from a left end portion of the horizontal portion 56D and of the same length as the wire connection portion 58A of the first busbar 55A. The vertical portion 57D is provided with an inclined portion 59D obliquely extending in a downward-forward direction from a substantially central portion thereof, and a terminal fitting portion 60D narrower than the inclined portion 59D and vertically extending downward from a lower end portion of the inclined portion 59D, such that its lowermost edge is aligned with that of the terminal fitting portion 60A of the first busbar 55A. Also, a crimp portion 62D is provided at an end portion of the wire connection portion 58D, where the fourth wire 13D is crimped to the fourth busbar 55D by swaging the crimp portion 62D.

The fifth busbar 55E includes a horizontal portion 56E having a vertically oriented and horizontally extending plane surface, which is shorter than the horizontal portion 56B of the second busbar 55B and longer than the horizontal portion 56A of the first busbar 55A; a vertical portion 57E vertically extending downward from a right end portion of the horizontal portion 56E and shorter than the vertical portion 57A of the first busbar 55A; and a wire connection portion 58E extending backward from a left end portion of the horizontal portion 56E and of the same length as the wire connection portion 58B of the second busbar 55B. The vertical portion 57E is provided with a terminal fitting portion 60E narrower than an upper end portion thereof and extending downward from a lower end portion thereof, such that its lowermost edge is aligned with that of the terminal fitting portion 60A of the first busbar 55A. Also, a crimp portion 62E is provided at an end portion of the wire connection portion 58E, where the fifth wire 13E is crimped to the fifth busbar 55E by swaging the crimp portion 62E.

The sixth busbar 55F includes a horizontal portion 56F having a vertically oriented and horizontally extending plane surface, which is shorter than the horizontal portion 56C of the third busbar 55C and longer than the horizontal portion 56B of the second busbar 55B; a vertical portion 57F vertically extending downward from a right end portion of the horizontal portion 56F and shorter than the vertical portion 57A of the first busbar 55A; and a wire connection portion 58F extending backward from a left end portion of the horizontal portion 56F and of the same length as the wire connection portion 58C of the third busbar 55C. The vertical portion 57F is provided with an inclined portion 59F obliquely extending in a downward-backward direction from a substantially central portion thereof, and a terminal fitting portion 60F narrower than the inclined portion 59F and vertically extending downward from a lower end portion of the inclined portion 59F, such that its lowermost edge is aligned with that of the terminal fitting portion 60A of the first busbar 55A. Also, a crimp portion 62F is provided at an end portion of the wire connection portion 58F, where the sixth wire 13F is crimped to the sixth busbar 55F by swaging the crimp portion 62F.

[Separators 63A, 63B, 63C]

The first to the sixth busbars 55A to 55F described above are respectively held among the first to the third separators 63A, 63B, 63C. The structure of each separator 63A to 63C will be described hereunder. The first to the third three separators 63A to 63C are made of an insulative material (a synthetic resin), and formed in a bent plate shape in different lengths and configurations of end portions, so as to mate with the horizontal portions 56A to 56F, the vertical portions 57A to 57F and the wire connection portions 58A to 58F of the busbars 55A to 55F. The first separator 63A confronts the casing 11 enclosing the inverter 10; the second separator 63B is superposed on the first separator 63A on an opposite side of the inverter 10; and the third separator 63C is superposed on the second separator 63B on an opposite side of the first separator 63A.

The first separator 63A includes a first chamber 64A for slide-inserting therein the first busbar 55A from above, and a fourth chamber 64D for slide-inserting therein the fourth busbar 55D from below.

The first separator 63A is constituted of an inner wall 65A confronting the casing 11 covering the inverter 10, an outer wall 66A located on an opposite side of the casing 11 across the inner wall 65A, and a partition wall 67A connecting the inner wall 65A and the outer wall 66A and separating the first chamber 64A and the fourth chamber 64D.

The inner wall 65A includes a horizontal portion 65A-A having a vertically oriented and horizontally extending plane surface; a projecting portion 65A-B projecting downward from a right end portion of the horizontal portion 65A-A; and a wire accommodation wall 65A-C extending backward from a left end portion of the horizontal portion 65A-A. The projecting portion 65A-B includes an inclined portion 65A-D inclined in a downward-forward direction from the horizontal portion 65A-A and a wire-side terminal guide 65A-E of a substantially trapezoidal shape vertically extending downward from a lower end portion of the inclined portion 65A-D. At an end portion of the wire accommodation wall 65A-C, a horizontal slit (not shown) is formed at a substantially central position of its height.

The outer wall 66A includes a horizontal portion 66A-A having a vertically oriented and horizontally extending plane surface, which is shorter than the horizontal portion 65A-A of the inner wall 65A; a projecting portion 66A-B projecting downward from a right end portion of the horizontal portion 66A-A; and a wire accommodation wall 66A-C extending backward from a left end portion of the horizontal portion 66A-A and longer than the wire accommodation wall 65A-C of the inner wall 65A. The projecting portion 66A-B includes an inclined portion 66A-D extending in a downward-forward direction from the horizontal portion 66A-A and a wire-side terminal guide 66A-E of a substantially trapezoidal shape vertically extending downward from a lower end portion of the inclined portion 66A-D. The wire-side terminal guide 66A-E is provided with an inclined rib 66A-G protruding toward the right from the left side face thereof. An end portion of the wire accommodation wall 66A-C is inclined toward the rear left for accommodating the first wire 13A and the fourth wire 13D, and then straightly extending backward. At an end portion of the wire accommodation wall 66A-C, a horizontal slit (not shown) is formed at a substantially central position of its height.

The partition wall 67A is formed so as to horizontally extend between the inner wall 65A and the outer wall 66A, substantially along a center line in the vertical direction thereof, and to downwardly extend from a right end portion of the inner wall 65A, thus to join the inclined rib 66A-G.

The first chamber 64A is defined by an upper portion and a right end portion of the outer wall 66A, an upper portion of the inner wall 65A and the partition wall 67A, and has an opening facing upward and rightward. The second chamber 64B is defined by a lower portion of the outer wall 66A, a lower portion of the inner wall 65A and the partition wall 67A, and has an opening facing downward.

The second separator 63B includes a second chamber 64B for slide-inserting therein the second busbar 55B from above, and a fifth chamber 64E for slide-inserting therein the fifth busbar 55E from below.

The second separator 63B is constituted of an inner wall 65B confronting the outer wall 66A of the first separator 63A, an outer wall 66B located on an opposite side of the outer wall 66A of the first separator 63A across the inner wall 65B, and a partition wall 67B connecting the inner wall 65B and the outer wall 66B and separating the second chamber 64B and the fifth chamber 64E.

The inner wall 65B includes a horizontal portion 65B-A having a vertically oriented and horizontally extending plane surface; a projecting portion 65B-B projecting downward from a right end portion of the horizontal portion 65B-A; and a wire accommodation wall 65B-C extending backward from a left end portion of the horizontal portion 65B-A. The projecting portion 65B-B includes a base portion 65B-H of a substantially rectangular shape, vertically extending downward from the horizontal portion 65B-A and two wire-side terminal guides 65B-E of a substantially trapezoidal shape, formed side by side at a lower end portion of the base portion 65B-H. Also, at an end portion of the wire accommodation wall 65B-C, a horizontal slit (not shown) is formed at a substantially central position of its height.

The outer wall 66B includes a horizontal portion 66B-A having a vertically oriented and horizontally extending plane surface, which is of the same length as the horizontal portion 65B-A of the inner wall 65B; a projecting portion 66B-B projecting downward from a right end portion of the horizontal portion 66B-A; and a wire accommodation wall 66B-C extending backward from a left end portion of the horizontal portion 66B-A and longer than the wire accommodation wall 65B-C of the inner wall 65B. The projecting portion 66B-B includes a base portion 66B-H of a substantially rectangular shape, vertically extending downward from the horizontal portion 66B-A and two wire-side terminal guides 66B-E of a substantially trapezoidal shape, formed side by side at a lower end portion of the base portion 65B-H. An end portion of the wire accommodation wall 66B-C is inclined toward the rear left for accommodating the second wire 13B and the fifth wire 13E, and then straightly extending backward. Also, at an end portion of the wire accommodation wall 66B-C, a horizontal slit (not shown) is formed at a substantially central position of its height.

The partition wall 67B is formed so as to horizontally extend between the inner wall 65B and the outer wall 66B, substantially along a center line in the vertical direction thereof, and to downwardly extend from a right end portion of the inner wall 65B, thus to join the wire-side terminal guides 65B-E and 66B-E.

The second chamber 64B is defined by an upper portion and a right end portion of the outer wall 66B, an upper portion of the inner wall 65B and the partition wall 67B, and has an opening facing upward and rightward. The fifth chamber 64E is defined by a lower portion of the outer wall 66B, a lower portion of the inner wall 65B and the partition wall 67B, and has an opening facing downward.

The third separator 63C includes a third chamber 64C for slide-inserting therein the third busbar 55C from above, and a sixth chamber 64F for slide-inserting therein the sixth busbar 55F from below.

The third separator 63C is constituted of an inner wall 65C confronting the outer wall 66B of the second separator 63B, an outer wall 66C located on an opposite side of the outer wall 66B of the second separator 63B across the inner wall 65C, and a partition wall 67C connecting the inner wall 65C and the outer wall 66C and separating the third chamber 64C and the sixth chamber 64F.

The inner wall 65C includes a horizontal portion 65C-A having a vertically oriented and horizontally extending plane surface; a projecting portion 65C-B projecting downward from a right end portion of the horizontal portion 65C-A; and a wire accommodation wall 65C-C extending backward from a left end portion of the horizontal portion 65C-A. The projecting portion 65C-B includes an inclined portion 65C-D extending in a backward-downward direction from the horizontal portion 65C-A and a wire-side terminal guide 65C-E of a substantially trapezoidal shape vertically extending downward from a lower end portion of the inclined portion 65C-D. Also, at an end portion of the wire accommodation wall 65C-C, a horizontal slit (not shown) is formed at a substantially central position of its height.

The outer wall 66C includes a horizontal portion 66C-A having a vertically oriented and horizontally extending plane surface, which is longer than the horizontal portion 65C-A of the inner wall 65C; a projecting portion 66C-B projecting downward from a right end portion of the horizontal portion 66C-A; and a wire accommodation wall 66C-C extending backward from a left end portion of the horizontal portion 66C-A and longer than the wire accommodation wall 65C-C of the inner wall 65C. The projecting portion 66C-B includes an inclined portion 66C-D extending in a backward-downward direction from the horizontal portion 66C-A and a wire-side terminal guide 66C-E of a substantially trapezoidal shape vertically extending downward from a lower end portion of the inclined portion 66C-D. The wire-side terminal guide 66C-E is provided with an inclined rib 66C-G protruding toward the left from the right side face thereof. An end portion of the wire accommodation wall 66C-C is inclined toward the rear left for accommodating the third wire 13C and the sixth wire 13F, and then straightly extending backward. Also, at an end portion of the wire accommodation wall 66C-C, a horizontal slit (not shown) is formed at a substantially central position of its height.

The partition wall 67C is formed so as to horizontally extend between the inner wall 65C and the outer wall 66C, substantially along a center line in the vertical direction thereof, and to downwardly extend from a right end portion of the inner wall 65C, thus to join the inclined rib 66C-G.

The third chamber 64C is defined by an upper portion and a right end portion of the outer wall 66C, an upper portion of the inner wall 65C and the partition wall 67C, and has an opening facing upward and rightward. The sixth chamber 64F is defined by a lower portion of the outer wall 66C, a lower portion of the inner wall 65C and the partition wall 67C, and has an opening facing downward.

[Assembly of the Busbars 55A to 55F and the Separators 63A to 63C]

The busbars 55A to 55F and the separators 63A to 63C may be assembled in the following process.

To the first separator 63A, the first busbar 55A and the fourth busbar 55D are combined. More specifically, the first busbar 55A is fitted into the first chamber 64A from above, and the fourth busbar 55D is fitted into the fourth chamber 64D from below. When the first busbar 55A and the fourth busbar 55D have been assembled, the two terminal fittings 60A and 60D are aligned side by side and projecting downward from the first separator 63A, at positions respectively corresponding to the wire-side terminal guides 65A-E and 66A-E. A left side face of the terminal fitting 60A of the first busbar 55A is guided by a right side face of the rib 66A-G of the first separator 63A. Also, the two wire connection portions 58A and 58D are located in an upper and a lower region between the wire accommodation wall 65A-C and the wire accommodation wall 66A-C, such that the first wire 13A and the fourth wire 13D are backwardly led out of the first separator 63A.

To the second separator 63B, the second busbar 55B and the fifth busbar 55E are combined. More specifically, the second busbar 55B is fitted into the second chamber 64B from above, and the fifth busbar 55E is inserted into the fifth chamber 64E from below. When the second busbar 55B and the fifth busbar 55E have been assembled, the two terminal fittings 60B and 60E are aligned side by side and projecting downward from the second separator 63B, at positions respectively corresponding to the wire-side terminal guides 65B-E and 66B-E. Also, the two wire connection portions 58B and 58E are located in an upper and a lower region between the wire accommodation wall 65B-C and the wire accommodation wall 66B-C, such that the second wire 13B and the fifth wire 13E are backwardly led out of the second separator 63B.

To the third separator 63C, the third busbar 55C and the sixth busbar 55F are combined. More specifically, the third busbar 55C is inserted into the third chamber 64C from above, and the sixth busbar 55F is inserted into the sixth chamber 64F from below. When the third busbar 55C and the sixth busbar 55F have been assembled, the two terminal fittings 60C and 60F are aligned side by side and projecting downward from the third separator 63C, at positions respectively corresponding to the wire-side terminal guides 65C-E and 66C-E. A right side face of the terminal fitting 60F of the sixth busbar 55F is guided by a left side face of the rib 66C-G of the third separator 63C. Also, the two wire connection portions 58C and 58F are located in an upper and a lower region between the wire accommodation wall 65C-C and the wire accommodation wall 66C-C, such that the third wire 13C and the sixth wire 13F are backwardly led out of the third separator 63C.

Meanwhile, an adhesive (not shown) may be applied in advance to a portion of the first to the sixth busbars 55A to 55F to be closely held between the first to the third separators 63A to 63C, so that the first to the sixth busbars 55A to 55F may be firmly fixed to the first to the sixth chambers 64A to 64F of the first to the third separators 63A to 63C respectively. Also, an adhesive (not shown) may be applied in advance to a portion of the first to the sixth busbars 55A to 55F to be projecting from the first to the third separators 63A to 63C and buried in the wire-side connector housing 42, so that a gap between the first to the sixth busbars 55A to 55F and the wire-side connector housing 42 may be securely sealed.

The first separator 63A, the second separator 63B and the third separator 63C are to be superposed in this sequence in a forward direction. At this stage, an adhesive (not shown) may be applied in advance either to an outer face of the outer wall 66A of the first separator 63A or to an outer face of the inner wall 65B of the second separator 63B, as well as either to an outer face of the outer wall 66B of the second separator 63B or to an outer face of the inner wall 65C of the third separator 63C. Applying such an adhesive prevents the first to the third separators 63A to 63C from being misaligned in a resin molding process.

The first busbar 55A and the fourth busbar 55D are provided with the inclined portion 59A and 59D inclined in a downward-forward direction, corresponding to which the first separator 63A is also provided with the inclined portions 65A-D and 66A-D inclined in a downward-forward direction. Also, the third busbar 55C and the sixth busbar 55F are provided with the inclined portion 59C and 59F inclined in a backward-downward direction, corresponding to which the third separator 63C is also provided with the inclined portions 65C-D and 66C-D inclined in a backward-downward direction. Accordingly, when the first to the third separators 63A to 63C are sequentially superposed from a backward direction, with the first busbar 55A and the fourth busbar 55D attached to the first separator 63A, with the second busbar 55B and the fifth busbar 55E attached to the second separator 63B, and with the third busbar 55C and the sixth busbar 55F attached to the third separator 63C, the terminal fitting portions 60A to 60F of the first to the sixth busbar 55A to 55F are aligned in a same plane, and in a row in a horizontal direction.

The first to the third separators 63A to 63C and the first to the sixth busbars 55A to 55F are to be set in a die (not shown) for molding. At this stage, an adhesive (not shown) may be applied in advance either to an outer face of the inner wall 65A of the first separator 63A or to an outer face of the outer wall 66C of the third separator, so as to prevent emergence of a gap between the first to the third separators 63A to 63C and the wire-side connector housing 42. When the separators 63A to 63C and the busbars 55A to 55F are set in the die, the terminal fitting portions 60A to 60F and the first to the sixth wires 13A to 13F are respectively engaged with a positioning groove (not shown) formed on the die. Under such a state, a melted resin is injected into the die. When the resin solidifies, molding of the wire-side connector housing 42, enclosing therein the first to the third separators 63A to 63C and the first to the sixth busbars 55A to 55F, is completed.

In the molding process, an injection pressure is applied to the first to the third separators 63A to 63C and the first to the sixth busbars 55A to 55F, however, the first to the sixth busbars 55A to 55F are not deformed by the injection pressure since a major portion of the first to the sixth busbars 55A to 55F is accommodated inside the first to the third separators 63A to 63C. Also, since the terminal fitting portions 60A to 60F projecting outside the first to the third separators 63A to 63C and the first to the sixth wires 13A to 13F are all engaged with the positioning grooves of the die and thereby inhibited from free movement, the terminal fitting portions 60A to 60F and the first to the sixth wires 13A to 13F are not deformed by the injection pressure.

[Action and Effect]

The wire-side connector 41 is to be fitted to the apparatus-side connector 14 from above. At this stage, the fitting portions 45A to 45C are respectively fitted to the hood portions 32A to 32C, so as to enclose the corresponding pair of terminal cylinders 16B. More specifically, the first fitting portion 45A is fitted to the first hood portion 32A, the second fitting portion 45B to the second hood portion 32B, and the third fitting portion 45C to the third hood portion 32C.

The above process causes the terminal fitting portions 60A to 60F of the first to the sixth busbars 55A to 55F to be inserted into the terminal cylinders 16B and to penetrate into the female connection portion 26 of the apparatus-side terminal fittings 23A to 23F, respectively, thereby achieving an elastic contact with the elastic contact pieces 25. This means that the first to the sixth busbars 55A to 55F are respectively connected to the apparatus-side terminal fittings 23A to 23F. More specifically, the fourth busbar 55D is connected to the first apparatus-side terminal fitting 23A, the first busbar 55A to the second apparatus-side terminal fitting 23B, the fifth busbar 55E to the third apparatus-side terminal fitting 23C, the second busbar 55B to the fourth apparatus-side terminal fitting 23D, the sixth busbar 55F to the fifth apparatus-side terminal fitting 23E, and the third busbar 55C to the sixth apparatus-side terminal fitting 23F.

When the wire-side connector 41 is fitted to the apparatus-side connector 14, the insertion holes 52 and 52 of the wire-side connector housing 42, the insertion holes 79 and 79 of the wire-side connector shield shell 68 and the screw holes 36 and 36 of the apparatus-side connector shield shell 31 are assembled in a matched manner with each other. Then bolts 88 and 88 are inserted from above through the insertion holes 52 and 52, the insertion holes 79 and 79 and the screw holes 36 and 36, to screw-fix the apparatus-side connector 14 and the wire-side connector 41.

As a result, the first output terminal of the U-phase output terminals of the inverter 10 is connected to the fourth wire 13D via the first apparatus-side terminal fitting 23A and the fourth busbar 55D. By contrast, the second output terminal is connected to the first wire 13A via the second apparatus-side terminal fitting 23B and the first busbar 55A.

Likewise, the third output terminal of the V-phase output terminals of the inverter 10 is connected to the fifth wire 13E via the third apparatus-side terminal fitting 23C and the fifth busbar 55E. By contrast, the fourth output terminal is connected to the second wire 13B via the fourth apparatus-side terminal fitting 23D and the second busbar 55B.

And the fifth output terminal of the W-phase output terminals of the inverter 10 is connected to the sixth wire 13E via the fifth apparatus-side terminal fitting 23E and the sixth busbar 55F. By contrast, the sixth output terminal is connected to the third wire 13C via the sixth apparatus-side terminal fitting 23F and the third busbar 55C.

As described above, according to the inverter connector 12 of this embodiment, since the wires 13A to 13C are already grouped so as to include all the U, V and W phases when led out of the wire-side connector 41, the wire group can be connected to the first motor as it is. Likewise, since the fourth to sixth wires 13D to 13F are already grouped so as to include all the U, V and W phases, the wire group can be connected to the second motor as it is. Such configuration eliminates the need of bending the wires in a large radius, thereby permitting distributing the wires 13A to 13F to the respective motors in a smaller space.

According to the inverter connector 12 of this embodiment, since the busbars 55A to 55F are formed by molding so as to be integrally retained in the wire-side connector housing 42, the number of manufacturing processes can be reduced unlike a case of press-fitting the busbars 55A to 55F into the wire-side connector housing 42, which results in improvement of productivity and reduction of manufacturing cost. Also, since the busbars 55A to 55F and the wire-side connector housing 42 are more firmly joined, a backlash or the like can be prevented.

According to the inverter connector 12 of this embodiment, since the apparatus-side connector housing 15 is enclosed in the apparatus-side connector shield shell 31, and such an apparatus-side connector shield shell 31 is attached to the casing 11 of the inverter 10, the conductive path from the inverter 10 to the motors can be securely shielded.

Further, referring to the molding process, widening a gap between busbars could be an option for preventing the busbars from contacting each other due to deformation by an injection pressure, however, this leads to an increase in bulk of the wire-side connector housing 42. By contrast, according to this embodiment, isolating the busbars 55A to 55F with the first to the third separators 63A to 63C permits securely preventing the busbars 55A to 55F from contacting each other due to an injection pressure, and hence reducing a gap between the busbars 55A to 55F, thus making it possible to miniaturize the wire-side connector housing 42.

Second Embodiment

A second embodiment of the present invention will be described according to FIG. 11 to FIG. 18. Hereinafter, the right-hand side of FIG. 11 will be defined as a front or forward side, and the left-hand side thereof as a rear or backward side.

[Inverter 100]

First, an inverter 100, to which an inverter connector 104 according to this embodiment is to be attached, will be described. The inverter 100 is constituted of an inverter main circuit (not shown) stored in a casing 101. The casing 101 is provided with a through hole 103 on a front face thereof for communication between inside and outside of the same. The casing 101 contains therein a first to a sixth, a total of six output terminals (not shown), which are directly connected to the inverter main circuit (not shown) and aligned in a row in pairs respectively corresponding to U, V and W phases. The first and the second output terminals are terminals of the U-phase; the third and the fourth ones are of the V-phase; and the fifth and the sixth ones are of the W-phase. These output terminals are exposed at the through hole 103 of the casing 101.

[Inverter Connector 104]

Then the inverter connector 104 according to this embodiment will be described. The inverter connector 104 includes an apparatus-side connector 135 connected to the output terminals (not shown) of the inverter 100 and a first and a second wire-side connectors 105A and 105B connected to a terminal portion of a first to a sixth wires 102A, 102B, 102C, 102D, 102E and 102F constituting a wire harness.

[Wire-Side Connectors 105A, 105B]

Firstly the wire-side connectors 105A and 105B will be described. The first wire-side connector 105A is connected to a terminal portion of the first to the third wires 102A to 102C, and includes a first wire-side connector shield shell 106A enclosing therein an entirety of a first wire-side connector housing 108A, in which a first to a third three wire-side terminal fittings 115A, 115B and 115C are disposed in this order from the left. The second wire-side connector 105B is connected to a terminal portion of the fourth to the sixth wires 102D to 102F, and includes a second wire-side connector shield shell 106B enclosing therein an entirety of a second wire-side connector housing 108B, in which a fourth to a sixth three wire-side terminal fittings 115D, 115E and 115F are disposed in this order from the left. Since the first to the sixth wires 102A to 102F, the first and the second wire-side connectors 105A and 105B, the first and the second wire-side connector housings 108A and 108B, the first to the sixth wire-side terminal fittings 115A to 115F, and the first and the second wire-side connector shield shells 106A and 106B are of an identical structure respectively, these will be integrally referred to as the wire 102, the wire-side connector 105, the wire-side connector housing 108, the wire-side terminal fitting 115 and the wire-side connector shield shell 106, in the subsequent passage.

The wire-side connector shield shell 106 is made of a metal material, and of a rectangular box shape with its longitudinal side horizontally oriented and having an opening on a lower face thereof. The wire-side connector shield shell 106 is provided with a cylindrical shape fitting portion 107 having an elliptical cross-section, upwardly projecting from an upper side thereof. The wire-side connector housing 108 is joined to the fitting portion 107 from below.

The wire-side connector housing 108 is made of a synthetic resin, and integrally molded so as to include three cylindrical portions 109, 109 and 109 each having a vertical axial line, disposed side by side and linked with one another via an outer wall. The wire-side connector housing 108 is provided with a pair of seal ring retaining ribs 110 protruding along an outer circumference of a central portion in the vertical direction thereof, and a seal ring 111 is attached between the seal ring retaining ribs 110. In a region of each cylindrical portion 109 below the seal ring retaining ribs 110, two vertical ribs 114 are provided, one on a side wall of the front face and the other on a side wall of the rear face. At the front and rear faces of linking portions between the cylindrical portions 109, a total of four cantilever type lances 112 are formed so as to upwardly extend from the seal ring retaining rib 110 as a base, two each on a front face and a rear face of the wire-side connector housing 108. The lances 112 on a front face of the wire-side connector housing 108 are enclosed from three directions by protection ribs 113 provided on both sides and a rear face thereof, while the lances 112 on a rear face of the wire-side connector housing 108 are enclosed from three directions by protection ribs 113 provided on both sides and a front face thereof. The lances 112 are engaged with an upper edge of the fitting portion 107 of the wire-side connector shield shell 106, thereby preventing the wire-side connector housing 108 from falling off.

The wire-side terminal fitting 115 is inserted from above into the cylindrical portion 109 of the wire-side connector housing 108. The wire-side terminal fitting 115 includes a terminal main body 120 of a thick plate material and an elastic contact piece 121 thinner than the terminal main body 120, joined thereto (See FIG. 15 and FIG. 17). The terminal main body 120 includes a square fitting portion 117 and a crimp portion 116 formed atop the square fitting portion 117. The square fitting portion 117 is of a vertically oriented square cylindrical shape having an opening on both ends, and a lance hole 125 is formed on a rear wall 124 of the square fitting portion 117, to which a cantilever type lance 126 downwardly extending from a lower end portion of an inner wall of the cylindrical portion 109 is engaged, thereby preventing the wire-side terminal fitting 115 from coming off upward.

On the part of the crimp portion 116, the wire 102 is crimped thereto and led out upward from the cylindrical portion 109. A cylindrical rubber plug 118 is fitted over the wire 102. The rubber plug 118 is in close contact with a rear end portion of an inner circumferential surface of the cylindrical portion 109, to thereby prevent moisture intrusion from an upper outside area into the cylindrical portion 109. Also, the rubber plug 118 fitted over the wire 102 is prevented from slipping off by a cylindrical holder 119 locked inside the cylindrical portion 109. The first wire 102A is connected to the first wire-side terminal fitting 115A; the second wire 102B is connected to the second wire-side terminal fitting 115B; the third wire 102C is connected to the third wire-side terminal fitting 115C; the fourth wire 102D is connected to the fourth wire-side terminal fitting 115D; the fifth wire 102E is connected to the fifth wire-side terminal fitting 115E; and the sixth wire 102F is connected to the sixth wire-side terminal fitting 115F.

Since the wire 102 is upwardly led out of the respective cylindrical portions 109, a total of three wires 102 are upwardly led out of each wire-side connector housing 108. The three wires 102 are integrally shielded by a cylindrical shielding material 128 formed of a meshed fine metal wire. The shielding material 128 is joined to the fitting portion 107 by a swaging ring 127, thus to achieve electrical connection between the shielding material 128 and the wire-side connector shield shell 106.

On the other hand, the other end portion of the wires 102 is connected to a three-phase motor which is not shown. More specifically, the first wire 102A is connected to a U-phase of a first motor (not shown); the second wire 102B is connected to a V-phase of the first motor (not shown); and the third wire 102C is connected to a W-phase of the first motor (not shown). Likewise, the fourth wire 102D is connected to a U-phase of a second motor (not shown); the fifth wire 102E is connected to a V-phase of the second motor (not shown); and the sixth wire 102E is connected to a W-phase of the second motor (not shown).

The wire-side connector shield shell 106 is provided with a pair of slits 133, 133 vertically extending in parallel with side edges of both of lateral faces thereof. The slits 133 and 133 serve to guide a first and a second slide lever 129A and 129B which cooperate with a pair of cam followers 139 and 139 (to be described later) to perform a cam function. The first slide lever 129A is engaged with the first wire-side connector shield shell 106A, and the second slide lever 129B is engaged with the second wire-side connector shield shell 106. Hereafter, since the first and the second slide levers 129A and 129B are of an identical structure, these will be simply referred to as the slide lever 129.

The slide lever 129 includes two cam plates 131 and 131 of a horizontally extended plate shape and a connection plate 132 connected to an end portion of each cam plate 131 and 131. The slide lever 129 is engaged with the wire-side connector shield shell 106 with the cam plates 131 and 131 fitted into the slits 133 and 133, such that the slide lever 129 may move left and right between an initial position and a fitting position by being guided by the slits 133 and 133. Here, the initial position of the first slide lever 129A is on the left side of a fitting position, while that of the second slide lever 129B is on the right side of a fitting position.

The cam plates 131 and 131 are respectively provided with a cam groove 130 having an opening at the lower end close to an end portion thereof opposite the connection plate 132 and diagonally extending upward toward the connection plate 132.

The wire-side connector shield shell 106 is provided with two insertion holes 134, one each in the proximity of left and right end portions of an upper face thereof, for screw-fixing the wire-side connector 105 and the apparatus-side connector 135.

[Apparatus-Side Connector 135]

The apparatus-side connector 135 will now be described. The apparatus-side connector 135 includes a supporting base 143 and an apparatus-side connector housing 149 placed on the supporting base 143, which are integrally enclosed in an apparatus-side connector shield shell 136 made of a metal material. The apparatus-side connector housing 149 is formed through molding a first to a sixth six busbars 159A, 159B, 159C, 159D, 159E and 159F.

The apparatus-side connector shield shell 136 is made of a metal material, and of a rectangular box shape with a longitudinal side thereof horizontally oriented and having an opening on a rear face thereof. The apparatus-side connector shield shell 136 is provided with two attachment bases 140 and 140 horizontally protruding from a rear face thereof, and each of the attachment bases 140 and 140 is provided with two insertion holes 141A and 141A located close to its upper and lower end portions, through which the apparatus-side connector shield shell 136 can be screw-fixed to the casing 101. Further, the apparatus-side connector shield shell 136 is provided with an insertion hole 141B at a central position of an upper end portion of the box-shape portion thereof, for screw-fixing the apparatus-side connector shield shell 136 to the casing 101. The apparatus-side connector shield shell 136 is fixed to the casing 101 with bolts 146 thread-fitted to the insertion holes 141A, 141A and 141B.

On an upper face of the apparatus-side connector shield shell 136, a first and a second fitting portions 137A, 137B of a rectangular box shape are disposed side by side with a longitudinal side thereof horizontally oriented, as designated by 137A and 137B from the left, and a cavity 138 and 138 having an elliptical cross-section is formed in each of the fitting portions 137A and 137B. The fitting portions 137A and 137B are respectively provided with two screw holes 148A and 148A located in left and right end portions, i.e. a total of four screw holes, for screw-fixing the apparatus-side connector 135 and the wire-side connector 105.

The first and the second fitting portions 137A and 137B are provided with a pair of cam followers 139 and 139, one each projecting from a front and a rear face thereof. The cam followers 139 and 139 are of a columnar shape with its axial line oriented in a back and forth direction.

The apparatus-side connector shield shell 136 is provided with two screw holes 148B and 148B in left and right end portions of its box-shape portion, for screw-fixing the apparatus-side connector shield shell 136 to the supporting base 143.

The supporting base 143 is of a rectangular box shape with an opening on a rear face thereof. The supporting base 143 is provided with two insertion holes 144 and 144 in left and right end portions of a front face thereof, in each of which a metal collar 145 and 145 is buried. Supporting base fixing bolts 147 and 147 are thread-fitted with the metal collars 145 and 145 from a backward direction, respectively, so as to screw-fix the supporting base 143 and the apparatus-side connector shield shell 136.

On top of the supporting base 143, the apparatus-side connector housing 149 made of a synthetic resin is placed. The apparatus-side connector housing 149 includes a busbar storage portion 156 of a slender plate shape horizontally oriented, a first and a second apparatus-side terminal storage portions 150A and 150B of a cylindrical shape having an elliptical cross-section and upwardly projecting from left and right end portions of the busbar storage portion 156, and a first to a third inverter terminal storage portions 157A, 157B and 157C having an elliptical cross-section and backwardly projecting from left and right end portions and a central portion of the busbar storage portion 156.

The first apparatus-side terminal storage portion 150A is located in a left end portion of the busbar storage portion 156, while the second apparatus-side terminal storage portion 150B is located in a right end portion of the busbar storage portion 156. Hereafter, since the first and the second apparatus-side terminal storage portions 150A and 150B are of an identical structure, these will be simply referred to as the apparatus-side terminal storage portion 150.

The apparatus-side terminal storage portion 150 is constituted of an outer wall having an elliptical cross-section, enclosing therein three terminal cylinders 151, 151 and 151 each having a vertically oriented axial line and in mutual contact via a side wall thereof. Each of the terminal cylinders 151, 151 and 151 includes a cavity 152, in which a first to a sixth apparatus-side plate-shaped terminal fittings 162A, 162B, 162C, 162D, 162E and 162F are exposed.

The apparatus-side terminal storage portion 150 is provided with a pair of seal ring retaining ribs 153A projecting in the circumferential direction at the lower end portion thereof, at which an elliptical seal ring 153B is retained. Below the seal ring retaining ribs 153A, a plate-shaped supporting base 154 is provided so as to be projected forward from the busbar storage portion 156, the apparatus-side terminal storage portion 150 is formed in a unified body with the apparatus-side terminal storage portion 150, and three vertically extending reinforcing ribs 155, 155 and 155 are provided below the supporting base 154.

In a rear portion of the busbar storage portion 156, the first to the third inverter terminal storage portions 157A, 157B and 157C are located from the left. The first to the third inverter terminal storage portions 157A to 157C have an elliptical cross-section, and are provided with a pair of seal ring retaining ribs 158A and 158A projecting in the circumferential direction at the rear end portion thereof, at which an elliptical seal ring 158B is retained. Through a rear opening of the first to the third inverter terminal storage portions 157A to 157C, a first to a sixth plate-shaped inverter terminals 160A, 160B, 160C, 160D, 160E and 160F are projecting, in a pair in the respective inverter terminal storage portions 157A to 157C.

A circular hole 161 vertically penetrating through a rear end portion of the first inverter terminal 160A is fixed to a first output terminal (not shown) of the inverter 100, and a circular hole 161 vertically penetrating through a rear end portion of the second inverter terminal 160B is fixed to a second output terminal (not shown) of the inverter 100. Likewise, a circular hole 161 vertically penetrating through a rear end portion of the third inverter terminal 160C is fixed to a third output terminal (not shown) of the inverter 100, and a circular hole 161 vertically penetrating through a rear end portion of the fourth inverter terminal 160D is fixed to a fourth output terminal (not shown) of the inverter 100. And a circular hole 161 vertically penetrating through a rear end portion of the fifth inverter terminal 160E is fixed to a fifth output terminal (not shown) of the inverter 100, and a circular hole 161 vertically penetrating through a rear end portion of the sixth inverter terminal 160F is fixed to a sixth output terminal (not shown) of the inverter 100.

[Busbars 159A, 159B, 159C, 159D, 159E, 159F]

Now, the first to the sixth busbars 159A, 159B, 159C, 159D, 159E and 159F are made of a conductive slender plate material and formed by a bending process in different lengths and configurations of end portions. Here below, the structure of each of the busbars 159A, 159B, 159C, 159D, 159E and 159F will be described (See FIG. 14).

The first busbar 159A is formed substantially in an L-shape in a side view, and includes a vertical portion 163 which vertically extends and the first inverter terminal 160A bent substantially by right angles from the vertical portion 163 so as to backwardly extend. Approximately an upper half of the vertical portion 163 is formed thinner in plate thickness than a lower portion thereof, to thereby constitute the first apparatus-side terminal fitting 162A.

The second busbar 159B includes a horizontal portion 164 having a horizontally oriented and horizontally extending plane surface, a vertical portion 163 vertically extending upward from a right end portion of the horizontal portion 164 and longer than the vertical portion 163 of the first busbar 159A, a stepped portion 165 diagonally inclined in a backward-upward direction from a left end portion of the horizontal portion 164, and the second inverter terminal 160B backwardly extending from the stepped portion 165. Approximately an upper half of the vertical portion 163 is formed thinner in plate thickness than a lower portion thereof, to thereby constitute the second apparatus-side terminal fitting 162B.

The third busbar 159C includes a horizontal portion 164 having a horizontally oriented and horizontally extending plane surface and shorter than the horizontal portion 164 of the second busbar 159B, a vertical portion 163 vertically extending upward from a left end portion of the horizontal portion 164 and shorter than the vertical portion 163 of the first busbar 159A, a stepped portion 165 diagonally inclined in a backward-downward direction from a right end portion of the horizontal portion 164, and the third inverter terminal 160C backwardly extending from the stepped portion 165. From substantially the upper two thirds of the vertical portion 163 is formed thinner in plate thickness than a lower portion thereof, to thereby constitute the third apparatus-side terminal fitting 162C.

The fourth busbar 159D includes a horizontal portion 164 having a horizontally oriented and horizontally extending plane surface and of the same length as the horizontal portion 164 of the third busbar 159C, a vertical portion 163 vertically extending upward from a right end portion of the horizontal portion 164 and shorter than the vertical portion 163 of the first busbar 159A, a stepped portion 165 diagonally inclined in a backward-downward direction from a left end portion of the horizontal portion 164, and the fourth inverter terminal 160D backwardly extending from the stepped portion 165. From substantially the upper two thirds of the vertical portion 163 is formed thinner in plate thickness than a lower portion thereof, to thereby constitute the fourth apparatus-side terminal fitting 162D.

The fifth busbar 159E includes a horizontal portion 164 having a horizontally oriented and horizontally extending plane surface and of the same length as the horizontal portion 164 of the second busbar 159B, a vertical portion 163 vertically extending upward from a right end portion of the horizontal portion 164 and of the same length as the vertical portion 163 of the first busbar 159A, and the fifth inverter terminal 160E backwardly extending from the vertical portion 163. From substantially the an upper half of the vertical portion 163 is formed thinner in plate thickness than a lower portion thereof, to thereby constitute the fifth apparatus-side terminal fitting 162E.

The sixth busbar 159F is of the same shape as the first busbar 159A, i.e. formed substantially in an L-shape in a side view, and includes a vertical portion 163 and the sixth inverter terminal 160F bent substantially by right angles from the vertical portion 163 so as to backwardly extend. From substantially the an upper half of the vertical portion 163 is formed thinner in plate thickness than a lower portion thereof, to thereby constitute the fifth apparatus-side terminal fitting 162E.

[Assembly of the Busbars 159A to 159F]

The busbars 159A to 159F are to be set as follows in a molding die (not shown). First, the first busbar 159A is placed at a left end portion, with the vertical portion 163 vertically oriented and the first inverter terminal 160A horizontally oriented. Also, the sixth busbar 160F is placed at a right end portion, with the vertical portion 163 vertically oriented and the sixth inverter terminal 160F horizontally oriented.

Then, the second busbar 159B is placed on a right side of the first busbar 159A, with the vertical portion 163 vertically oriented and the second inverter terminal 160B horizontally oriented. Also, the fifth busbar 159E is placed on a left side of the sixth busbar 159F, with the vertical portion 163 vertically oriented and the fifth inverter terminal 160E horizontally oriented. Here, the horizontal portion 164 of the fifth busbar 159E is to be superposed on the horizontal portion 164 of the second busbar 159B.

The third busbar 159C and the fourth busbar 159D are sequentially placed from the left on a right side of the second busbar 159B. At this stage, the vertical portion 163 of the third and the fourth busbars 159C and 159D are to be vertically oriented, and the third and the fourth inverter-side terminals 160C and 160D are to be horizontally oriented. Also, the horizontal portions 164 of the third and the fourth busbars 159C and 159D are to be superposed on the horizontal portion 164 of the fifth busbar 159E.

Once the busbars 159A to 159F have been set as above, the inverter terminals 160A to 160F respectively corresponding to the busbars 159A to 159F are horizontally aligned in a row, and in three groups each including a pair of the inverter terminals. Specifically, the first and the second inverter terminals 160A and 160B constitute a pair; the third and the fourth inverter terminals 160C and 160D another pair; and the fifth and the sixth inverter terminals 160E and 160F still another pair. On the other hand, the apparatus-side terminal fittings 162A to 162F of the busbars 159A to 159F are horizontally aligned in a row at a same level, and in two groups each including three of the apparatus-side terminal fittings. Specifically, the first, the third and the fifth apparatus-side terminal fittings 162A, 162C and 162E constitute a group, and the second, the fourth and the sixth apparatus-side terminal fittings 162B, 162D and 162F constitute the other group.

When the busbars 159A to 159F are set in the die, the inverter terminals 160A to 160F and the apparatus-side terminal fittings 162A to 162F are all engaged with positioning grooves (not shown) formed on the die. Under such a state, a melted resin is injected into the die. When the resin solidifies, molding of the apparatus-side connector housing 149 enclosing therein the first to the sixth busbars 159A to 159F is completed.

Once the apparatus-side connector housing 149 has been molded as above, the first and the second inverter terminals 160A and 160B are projecting out of the first inverter terminal storage portion 157A; the third and the fourth inverter terminals 160C and 160D are projecting out of the second inverter terminal storage portion 157B; and the fifth and the sixth inverter terminals 160E and 160F are projecting out of the third inverter terminal storage portion 157C. On the other hand, the first, the third and the fifth apparatus-side terminal fittings 162A, 162C and 162E are accommodated in the first apparatus-side terminal storage portion 150A, and the second, the fourth and the sixth apparatus-side terminal fittings 162B, 162D and 162F are accommodated in the second apparatus-side terminal storage portion 150B.

[Operations and Working Effect]

The wire-side connector 105 and the apparatus-side connector 135 are to be fitted as follows. First, the first wire-side connector 105A is fitted to the first fitting portion 137A. Here, the first wire-side connector 105A is brought close to the first fitting portion 137A from above with the first slide lever 129A placed at an initial position, so that the opening of the cam groove 130 is engaged with the cam follower 139. When the first slide lever 129A placed at the initial position is pushed to the right, a cam effect produced by the engagement of the cam groove 130 and the cam follower 139 causes the first wire-side connector 105A to come closer to the first fitting portion 137A. When the first slide lever 129A is completely pushed in to the right, the cam follower 139 reaches a farthest end portion of the cam groove 130, to thereby complete the fitting of the first apparatus-side connector 105A and the first fitting portion 137A. Once the fitting has been completed, the first, the third and the fifth apparatus-side terminal fittings 162A, 162C and 162E enter into the square fitting portions 117, so that the elastic contact pieces 121 may achieve an elastic contact with the first, the third and the fifth apparatus-side terminal fittings 162A, 162C and 162E. As a result, connection is achieved between the first wire-side terminal fitting 115A and the first busbar 159A, between the second wire-side terminal fitting 115B and the third busbar 159C, and between the third wire-side terminal fitting 115C and the fifth busbar 159E.

Once the first wire-side connector 105A and the first fitting portion 137A are fitted to each other, the insertion hole 134 of the first wire-side connector shield shell 106A and the screw hole 148A of the first fitting portion 137A meet each other. Thereafter, a bolt 166 is inserted from above into the insertion hole 134 and the screw hole 148A, so that the bolt 166 is thread-fitted thus to screw-fix the first wire-side connector 105A and the first fitting portion 137A.

Then, the second wire-side connector 105B is fitted to the second fitting portion 137B. Here, the second wire-side connector 105B is brought close to the second fitting portion 137B from above with the second slide lever 129B placed at an initial position, so that the opening of the cam groove 130 is engaged with the cam follower 139. When the second slide lever 129B placed at the initial position is pushed to the left, a cam effect produced by the engagement of the cam groove 130 and the cam follower 139 causes the second wire-side connector 105B to come closer to the second fitting portion 137B. When the second slide lever 129B is completely pushed in to the left, the cam follower 139 reaches a farthest depth of the cam groove 130, to thereby complete the fitting of the second apparatus-side connector 105B and the second fitting portion 137B. Once the fitting has been completed, the second, the fourth and the sixth apparatus-side terminal fittings 162B, 162D and 162F enter into the square fitting portions 117, so that the elastic contact pieces 121 may achieve an elastic contact with the second, the fourth and the sixth apparatus-side terminal fittings 162B, 162D and 162F. As a result, connection is achieved between the fourth wire-side terminal fitting 115D and the second busbar 159B, between the fifth wire-side terminal fitting 15E and the fourth busbar 159D, and between the sixth wire-side terminal fitting 115F and the sixth busbar 159F.

Once the second wire-side connector 105B and the second fitting portion 137B are fitted to each other, the insertion hole 134 of the second wire-side connector shield shell 106B and the screw hole 148A of the second fitting portion 137B meet each other Thereafter, a bolt 166 is inserted from above into the insertion hole 134 and the screw hole 148A, so that the bolt 166 is thread-fitted thus to screw-fix the second wire-side connector 105B and the second fitting portion 137B.

As a result, the first output terminal of the U-phase output terminals of the inverter 100 is connected to the first wire 102A via the first apparatus-side terminal fitting 162A and the first busbar 159A. On the other hand, the second output terminal is connected to the fourth wire 102D via the second apparatus-side terminal fitting 162B and the second busbar 159B.

Likewise, the third output terminal of the V-phase output terminals of the inverter 100 is connected to the second wire 102B via the third apparatus-side terminal fitting 162C and the third busbar 159C. On the other hand, the fourth output terminal is connected to the fifth wire 102E via the fourth apparatus-side terminal fitting 162D and the fourth busbar 159D.

And the fifth output terminal of the W-phase output terminals of the inverter 100 is connected to the third wire 102C via the fifth apparatus-side terminal fitting 162E and the fifth busbar 159E. On the other hand, the sixth output terminal is connected to the sixth wire 102F via the sixth apparatus-side terminal fitting 162F and the sixth busbar 159F.

As described above, according to this embodiment, since the apparatus-side terminal fittings 162A to 162F provided in the apparatus-side connector housing 149 are grouped so as to include the U, V and W phases for the respective loads, once the apparatus-side connector housing 149 is fitted to the wire-side connector housings 108A and 108B, which is attached to a terminal portion of the wires 102, for example, the wires led out of the wire-side connector housings 108A and 108B are already grouped so as to include the U, V and W phases for the respective loads. Such a configuration eliminates the need for bending the wires in a large radius when distributing the wires 102 to the respective loads, thereby permitting distributing the wires 102 to the respective loads in a smaller space.

Other Embodiments

The present invention is not limited to the foregoing description and the embodiments described according to the drawings, but the following embodiments are also included in the technical scope of the present invention, and further thereto various modifications may be made without departing from the spirit of the present invention.

1. According to the first and the second embodiments, each of the wires is not individually shielded, and the first to the third wires, as well as the fourth to the sixth wires are integrally shielded in a shielding material, however without limitation to such a configuration, an individually shielded wire may be employed instead.

2. According to the first and the second embodiments, two three-phase loads are provided, however, three or more three-phase loads may be included according to the present invention.

3. According to the first embodiment the wires 13A to 13F led out of the wire-side connector 41 are in a direction orthogonal to a projecting direction of the female connection portion 26 of the apparatus-side terminal fitting 23, however without limitation to such an arrangement, the wires 13A to 13F may be led out in a direction parallel to the projecting direction of the apparatus-side terminal fitting 23 of the apparatus-side connector 14.

4. According to the second embodiment, the busbars 159A to 159F are enclosed in a molded resin constituting the apparatus-side connector housing 149, such that the molded resin serves as insulating the busbars 159A to 159F, however, without limitation to such a configuration, separators, for example, made of a resin may be inserted between the busbars 159A to 159F for insulation purposes after molding the apparatus-side connector housing 149. Alternatively, separators may be interposed between the busbars 159A to 159F, prior to the molding process.

5. According to the second embodiment, the square fitting portion 117 is inserted into the wire-side connector housing 108A and 108B, however, without limitation to such an arrangement, the square fitting portion 117 may be included in the wire-side connector housing 108A and 108B in the resin molding process.

What is claimed is:

1. A connector for an inverter, which individually connects output terminals provided on an inverter main circuit board in the inverter to a plurality of three-phase loads, the output terminals including a plurality of sets of output terminals, led out side by side, respectively corresponding to U, V and W phases, comprising:

an apparatus-side connector housing attached to a casing of the inverter, which includes a plurality of terminal fitting portions respectively corresponding to U, V and W phases, led out side by side in parallel, and a center of each terminal fitting portion lies in a plane, the apparatus-side connector housing including;

a plurality of busbars, each having on one end portion one of the plurality of terminal fitting portions where a mating connector of the apparatus-side connector housing is connected and on the other portion an inverter-side terminal where an output terminal of the inverter main circuit board is connected, wherein the busbars are divided and arranged into groups respectively corresponding to the U, V and W phases with respect to the inverter-side terminal, and the busbars are arranged into groups respectively including the U, V and W phases for connection to each of the three-phase loads, with respect to the plurality of terminal fitting portions.

2. A connector for an inverter according to claim 1, wherein the busbars are formed by molding so as to be integrally retained in the apparatus-side connector housing.

3. A connector for an inverter according to claim 1, further comprising:

a shield shell made of a conductive material, which encloses and retains the apparatus-side connector housing, wherein the shield shell is attached to a casing of the inverter.

4. A connector for an inverter according to claim 1, wherein the busbars are formed by molding with an insulating separator interposed between the busbars.

5. A connector for an inverter according to claim 1, wherein an insulating separator is interposed between the busbars.

6. A connector for an inverter, which individually connects output terminals provided on an inverter main circuit board in an inverter to a plurality of three-phase loads, the output terminals being divided into a plurality of output terminal sets respectively corresponding to U, V and W phases led out side by side, comprising:

an apparatus-side connector housing attached to a casing of the inverter, which includes a plurality of sets of apparatus-side terminal fittings respectively corresponding to U, V and W phases led out side by side in parallel, and a center of each terminal fitting lies in a first plane;

a wire-side connector housing to be fitted to the apparatus-side connector housing, which includes a plurality of busbars, each having on one end portion a terminal fitting portion led out side by side in parallel to another terminal fitting portion, and a center of each terminal fitting portion lies in a second plane, where the apparatus-side terminal fittings are electrically conducted with the wire side terminal fitting portions when the apparatus-side connector housing and the wire-side connector housing are fitted, and on the other end portion a wire connection portion where a wire from the three-phase loads is connected, wherein the busbars are divided and arranged into groups respectively corresponding to the U, V and W phases with respect to the terminal fitting portion, the busbars are divided and arranged into groups respectively including the U, V and W phases for connection to each of the three-phase loads, with respect to the wire connection portion, and the first plane and second plane are a single plane when the apparatus-side connector housing and the wire-side connector housing are joined.

7. The connector for an inverter according to claim 6, wherein the busbars are formed by molding so as to be integrally retained in the wire-side connector housing.

* * * * *

UNITED STATES PATENT AND TRADEMARK OFFICE

CERTIFICATE OF CORRECTION

PATENT NO. : 7,268,300 B2
APPLICATION NO. : 10/940709
DATED : September 11, 2007
INVENTOR(S) : Sho Miyazaki It is certified that error appears in the above-identified patent and that said Letters Patent is hereby corrected as shown below:

Title page, item, Assignee
73) 2nd Assignee should read as follows: Sumitomo Wiring Systems, Ltd. Mie, Japan Signed and Sealed this Fourth Day of March, 2008

JON W. DUDAS
*Director of the United States Patent and Trademark Office*